US010705450B2

(12) United States Patent
Koga et al.

(10) Patent No.: US 10,705,450 B2
(45) Date of Patent: Jul. 7, 2020

(54) METHOD OF FIXING REGULATING BLADE MADE OF RESIN MATERIAL

(71) Applicant: CANON KABUSHIKI KAISHA, Tokyo (JP)

(72) Inventors: Shunichi Koga, Abiko (JP); Teruaki Tsurusaki, Moriya (JP); Tomohiro Shiomi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/203,924

(22) Filed: Nov. 29, 2018

(65) Prior Publication Data

US 2019/0171131 A1 Jun. 6, 2019

(30) Foreign Application Priority Data

Dec. 5, 2017 (JP) ..... 2017-233789

(51) Int. Cl.
*G03G 15/08* (2006.01)

(52) U.S. Cl.
CPC ..... *G03G 15/0812* (2013.01); *G03G 15/081* (2013.01); *G03G 15/0818* (2013.01)

(58) Field of Classification Search
CPC ..... G03G 15/081; G03G 15/0812; G03G 15/0818
See application file for complete search history.

(56) References Cited

U.S. PATENT DOCUMENTS 5,128,716 A 7/1992 Kita
5,185,632 A * 2/1993 Yoshida ..... G03G 15/0812 399/284
7,764,912 B2 7/2010 Kondo et al.
2010/0221038 A1* 9/2010 Matsuzaki ..... G03G 21/0029 399/119
2011/0268477 A1* 11/2011 Matsuda ..... H01B 1/24 399/252

(Continued)

FOREIGN PATENT DOCUMENTS

JP 2013020085 A 1/2013
JP 2014197175 A 10/2014

(Continued)

OTHER PUBLICATIONS

Philippine Office Action issued in corresponding Philippine Patent Application No. 1/2018/000420 dated Feb. 12, 2019.

(Continued)

*Primary Examiner* — Francis C Gray
(74) *Attorney, Agent, or Firm* — Venable LLP

(57) ABSTRACT

A method of fixing a regulating blade made of a resin material includes an adhesive applying step of applying an adhesive onto a mounting portion; a first force applying step of applying a first force to the regulating blade so that the regulating blade is urged against the mounting portion; a second force applying step of applying a second force to the mounting portion so as to support the mounting portion; and a fixing step of fixing the regulating blade to the mounting portion by curing the adhesive applied on the mounting portion in the adhesive applying step in a state that the first force is applied to the regulating blade in the first force applying step and that the second force is applied to the mounting portion in the second force applying step.

10 Claims, 17 Drawing Sheets

(56) References Cited

U.S. PATENT DOCUMENTS

| | | | | |
|---|---|---|---|---|
| 2012/0027458 | A1* | 2/2012 | Matsuzaki ..... | G03G 21/0029 399/119 |
| 2013/0017002 | A1 | 1/2013 | Yoshikawa | |
| 2014/0255061 | A1 | 9/2014 | Yasumoto et al. | |
| 2015/0043948 | A1 | 2/2015 | Kanai et al. | |
| 2017/0010562 | A1* | 1/2017 | Wakabayashi ..... | G03G 15/0818 |

FOREIGN PATENT DOCUMENTS

| | | | |
|---|---|---|---|
| JP | 2015057624 | A | 3/2015 |
| JP | 2015090398 | A | 5/2015 |

OTHER PUBLICATIONS

Philippine Office Action issued in corresponding Philippine Application No. 1/2018/000420 dated Dec. 4, 2019.

* cited by examiner (a)

(b)

METHOD OF FIXING REGULATING BLADE MADE OF RESIN MATERIAL

FIELD OF THE INVENTION AND RELATED ART

The present invention relates to a method of fixing a regulating blade made of a resin material.

The developing device includes a developing device frame, a rotatable developer carrying member for carrying a developer in order to develop an electrostatic latent image formed on an image bearing member, and a regulating blade as a developer regulating member for regulating an amount of the developer carried on the developer carrying member. The regulating blade is provided opposed to the developer carrying member with a predetermined gap between itself and the developer carrying member over a direction parallel to a rotational axis of the developer carrying member (hereinafter, the gap is referred to as an SB gap). The SB gap refers to a minimum distance between the developer carrying member and the regulating blade. By adjusting a magnitude of this SB gap, an amount of the developer fed to a developing region where the developer carrying member opposes an image bearing member is adjusted.

In recent years, a developing device including a resin-made developer regulating member (regulating blade) prepared by molding a resin material and a resin-made developing device frame prepared by molding a resin material has been known (Japanese Laid-Open Patent Application (JP-A) 2014-197175).

SUMMARY OF THE INVENTION

A principal object of the first invention is to provide a method of fixing a regulating blade capable of suppressing a fluctuation of a magnitude of a gap between an image bearing member and the regulating blade with deformation of a developing device frame by a load exerted on the regulating blade when the regulating blade made of a resin material is fixed to the developing device frame made of a resin material with an adhesive.

According to an aspect the present invention, there is provided a method of fixing a regulating blade made of a resin material to a mounting portion of a developing device frame made of a resin material, wherein the regulating blade is provided opposed to and in non-contact with a developer carrying member for carrying a developer for developing an electrostatic latent image on an image bearing member and is capable of regulating an amount of the developer carried on the developer carrying member, the method comprising: an adhesive applying step of applying an adhesive onto the mounting portion; a first force applying step of applying a first force to the regulating blade so that the regulating blade mounted on the mounting portion on which the adhesive is applied in the adhesive applying step is urged against the mounting portion; a second force applying step of applying a second force to the mounting portion so as to support the mounting portion on which the adhesive is applied in the adhesive applying step; and a fixing step of fixing the regulating blade to the mounting portion by curing the adhesive applied on the mounting portion in the adhesive applying step in a state that the first force is applied to the regulating blade in the first force applying step and that the second force is applied to the mounting portion in the second force applying step.

Further features of the present invention will become apparent from the following description of exemplary embodiments with reference to the attached drawings.

Figure 17:
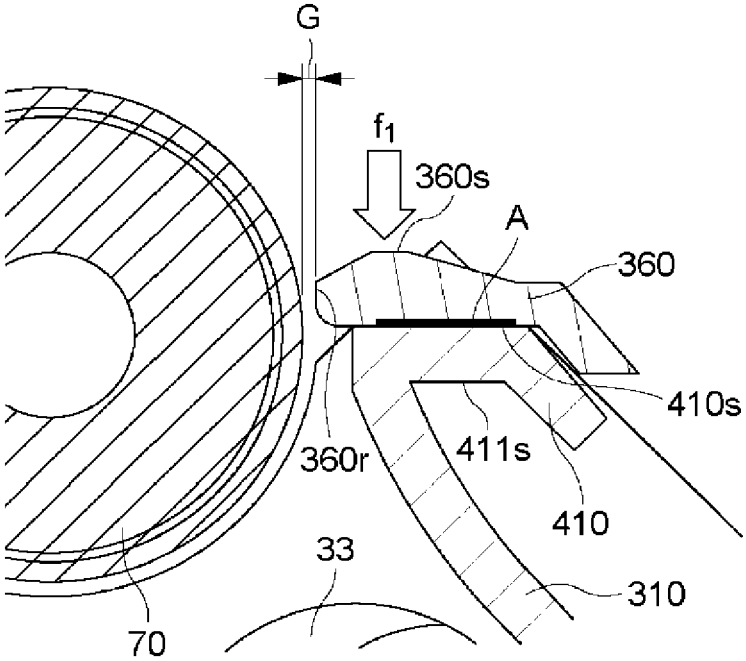
Figure 17:
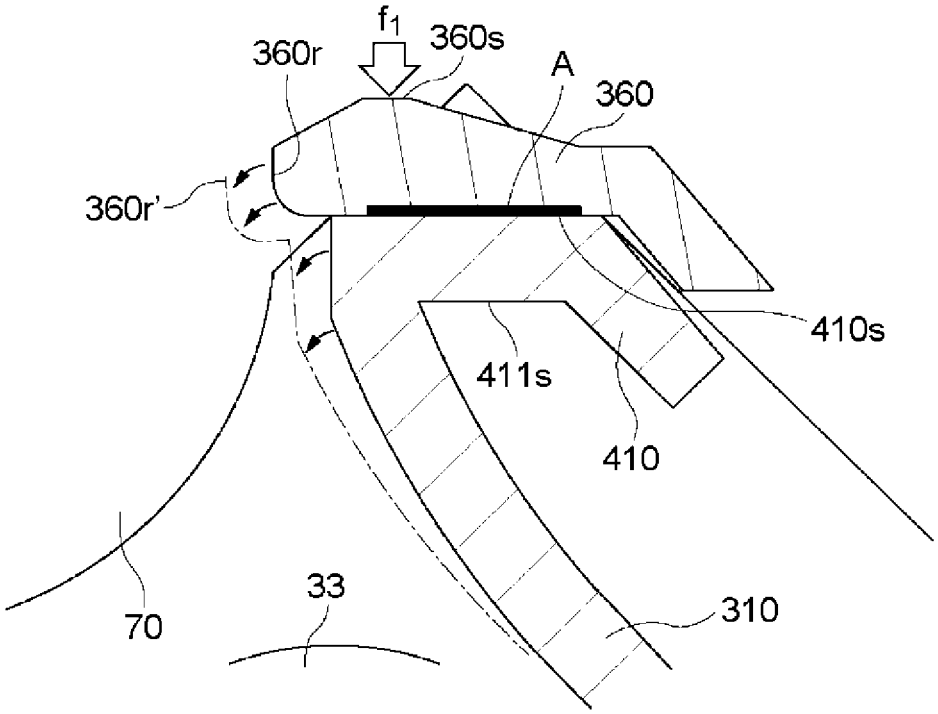

Parts (a) and (b) of FIG. 17 are sectional views for illustrating deformation of the resin-made developing device frame by a load exerted on the resin-made doctor blade.

Figure 18:
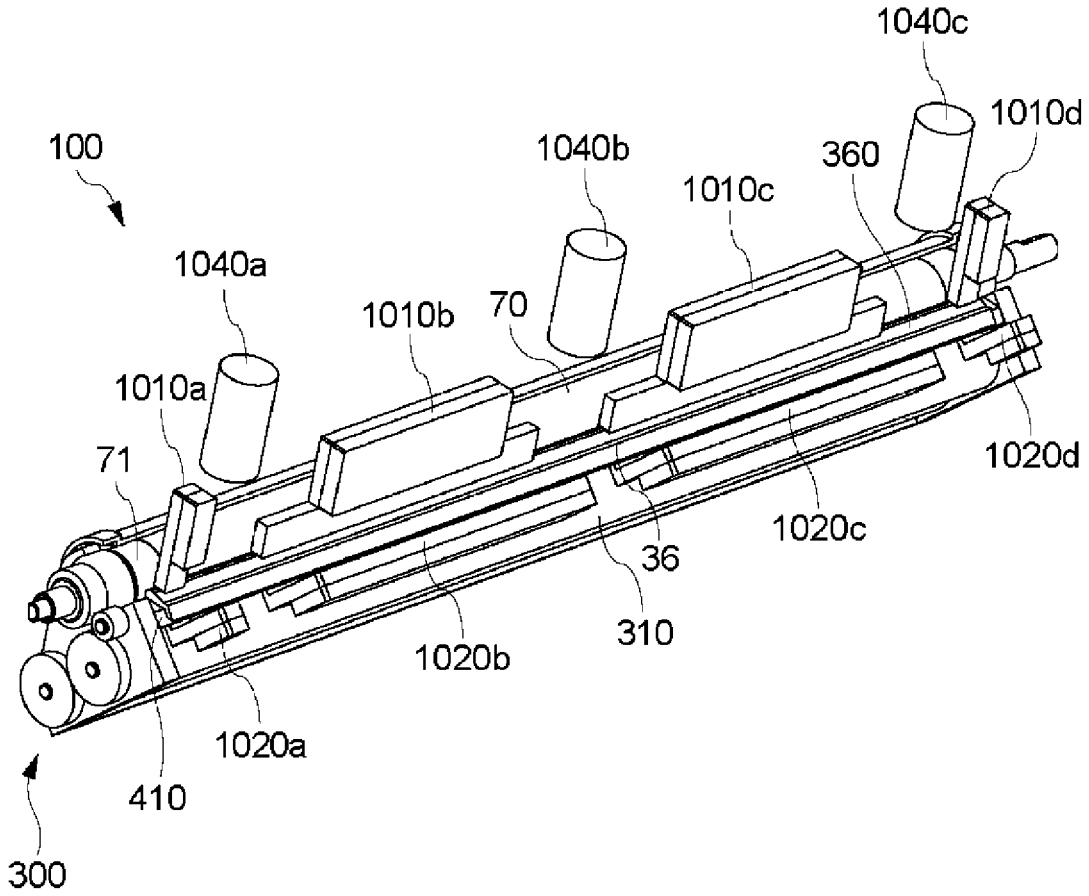

FIG. 18 is a schematic view for illustrating a step of the method of fixing the resin-made doctor blade.

Figure 19:
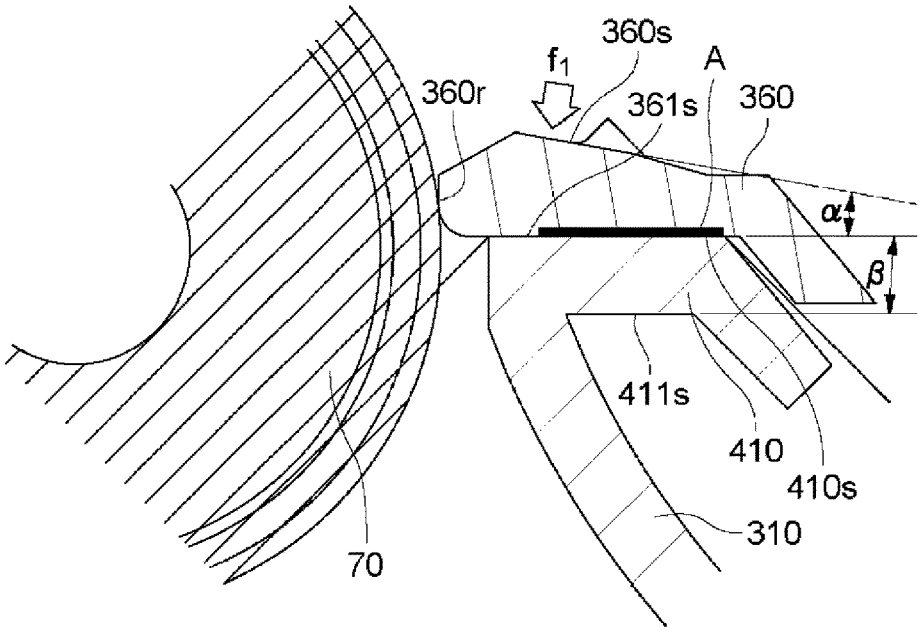

FIG. 19 is a sectional view (enlarged view) showing a structure of a developing device according to First Embodiment.

Figure 20:
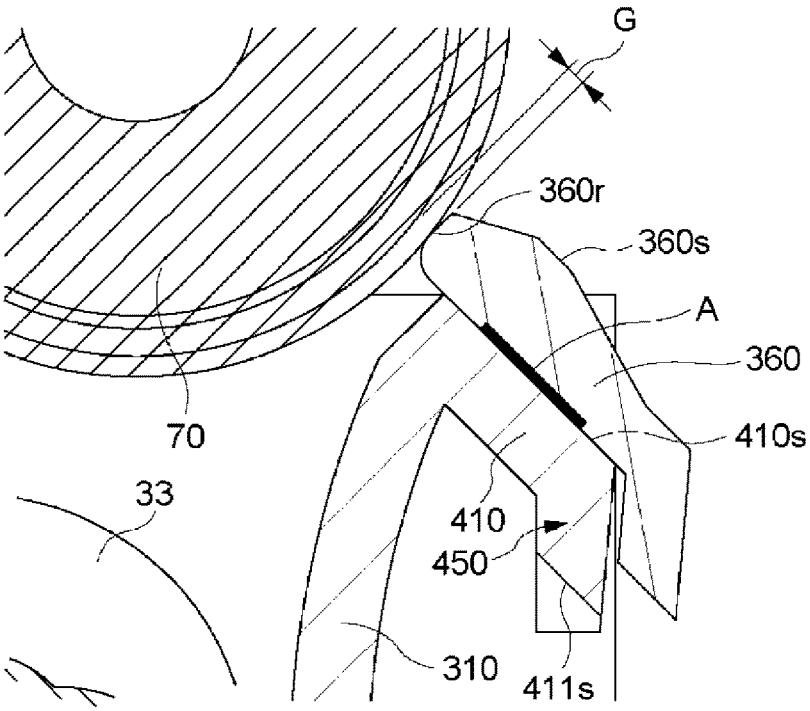

FIG. 20 is a sectional view (enlarged view) showing a structure of a developing device according to a modified example.

DESCRIPTION OF EMBODIMENTS

Embodiments of the direction will be specifically described with reference to the drawings. Incidentally, the following embodiments do not limit the present invention according to the claims, and all combinations of features described in First Embodiment are not necessarily essential to means for solving a problem of the present invention. The present invention can be carried out in various uses such as printers, various printing machines, facsimile machines and multi-function machines.

First Embodiment (Structure of Image Forming Apparatus)

Figure 1:
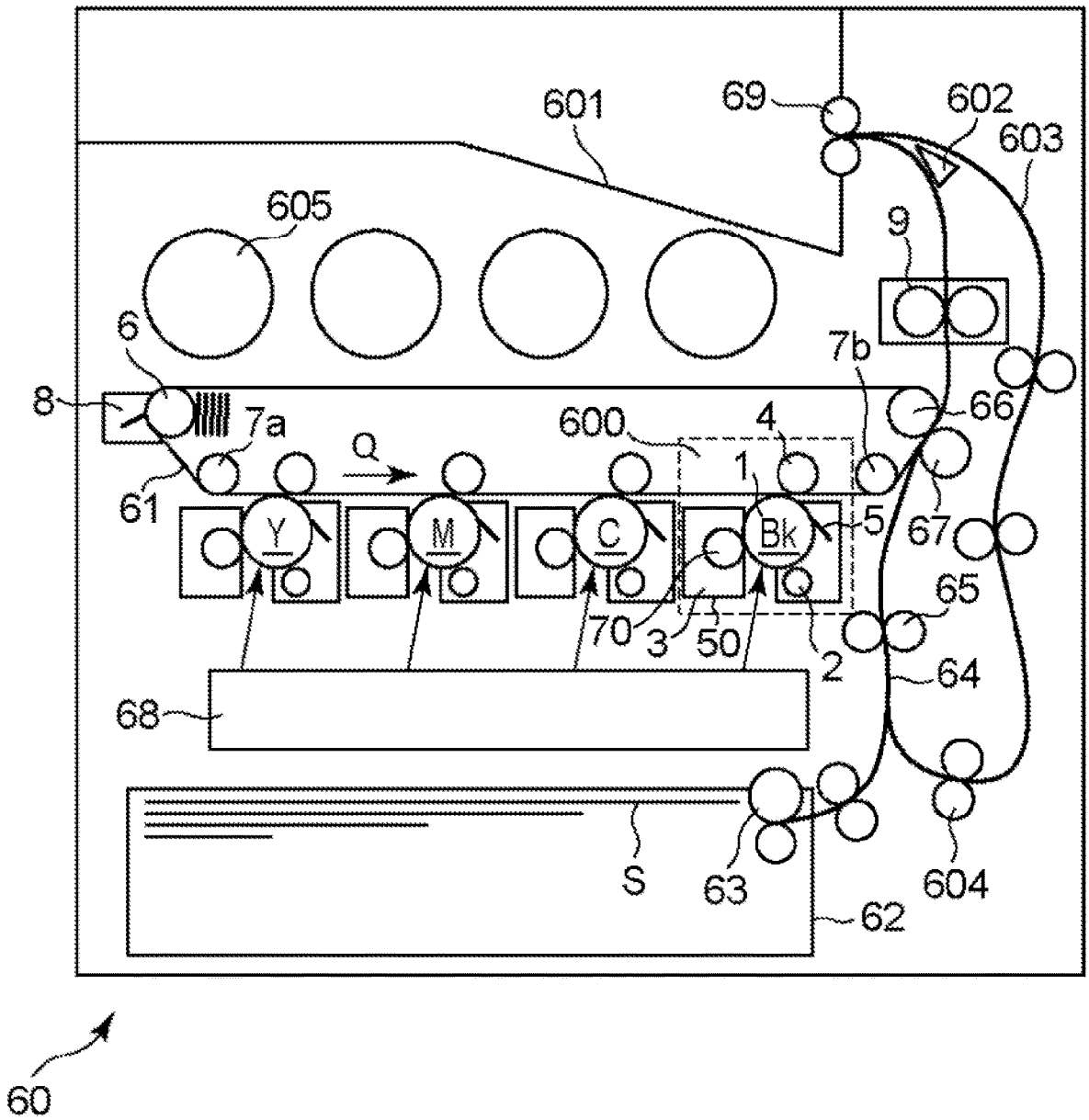
FIG. 1 is a sectional view showing a structure of an image forming apparatus.

First, a structure (constitution) of an image forming apparatus according to First Embodiment of the present invention will be described with reference to a sectional view of FIG. 1. As shown in FIG. 1, an image forming apparatus 60 includes an endless intermediary transfer belt (ITB) 61 as an intermediary transfer member and four image forming portions 600 provided from an upstream side toward a downstream side along a rotational direction (arrow Q direction of FIG. 1) of the intermediary transfer belt 61. The image forming portions 600 form toner images of colors of yellow (Y), magenta (M), cyan (C) and black (Bk), respectively.

The image forming portion 600 includes a rotatable photosensitive drum 1 as an image bearing member. Further, the image forming portion 600 includes a charging roller 2 as a charging means, a developing device 3 as a developing means, a primary transfer roller 4 as a primary transfer means and a photosensitive member cleaner 5 as a photosensitive member cleaning means, which are provided along a rotational direction of the photosensitive drum 1.

Each of the developing devices 3 is detachably mountable to the image forming apparatus 60. Each of the developing devices 3 includes a developing container 50 which accommodates a two-component developer (hereinafter, simply referred to as a developer) containing non-magnetic toner (hereinafter, simply referred to as toner) and a magnetic carrier. Further, each of toner cartridges in which toners of the colors of Y, M, C and Bk is detachably mountable to the image forming apparatus 60. The toners of the respective colors of Y, M, C and Bk pass through toner feeding paths and are supplied to the developing containers 50, respectively. Incidentally, details of each developing device 3 will be described later with reference to FIGS. 2 to 4, and details of each developing container 50 will be described later with reference to FIG. 5.

The intermediary transfer belt 61 is stretched by a tension roller 6, a follower roller 7*a*, the primary transfer roller 4, a follower roller 7*b* and an inner secondary transfer roller 66, and is fed and driven in the arrow Q direction of FIG. 1. The inner secondary transfer roller 66 also functions as a driving roller for driving the intermediary transfer belt 61. With rotation of the inner secondary transfer roller 66, the intermediary transfer belt 61 is rotated in the arrow Q direction of FIG. 1.

The intermediary transfer belt 61 is pressed from a back-surface side of the intermediary transfer belt 61 by the primary transfer rollers 4. Further, the intermediary transfer belt 61 is contacted to the photosensitive drums 1, so that a primary transfer nip as a primary transfer portion is formed between each of the photosensitive drums 1 and the intermediary transfer belt 61.

At a position opposing the tension roller 6 through the intermediary transfer belt 61, an intermediary transfer member cleaner 8 as a belt cleaning means is contacted to the intermediary transfer belt 61. Further, at a position opposing the inner secondary transfer roller 66 through the intermediary transfer belt 61, an outer secondary transfer roller 67 as a secondary transfer means is provided. The intermediary transfer belt 61 is sandwiched between the inner secondary transfer roller 66 and the outer secondary transfer roller 67. As a result, a secondary transfer nip as a secondary transfer portion is formed between the outer secondary transfer roller 67 and the intermediary transfer belt 61. At the secondary transfer nip, the toner image is attracted to a surface of a sheet S (for example, paper, a film or the like) by applying a predetermined pressing force (pressure) and a transfer bias (electrostatic load bias).

The sheets S are accommodated in a stacked state in a sheet accommodating portion 62 (for example, a feeding cassette, a feeding deck or the like). A feeding means 63 feeds the sheet S in synchronism with image forming timing by using, for example, a friction separation type or the like with a feeding roller or the like. The sheet S fed by the feeding means 63 is fed to a registration roller pair 65 provided at an intermediary position of a feeding path 64. After oblique movement correction and timing correction are carried out by the registration roller pair 65, the sheet S is fed to the secondary transfer nip. In the secondary transfer nip, timing when the sheet S reaches the secondary transfer nip and timing when the toner image reaches the secondary transfer nip coincide with each other, and thus secondary transfer is carried out.

Downstream of the secondary transfer nip with respect to a feeding direction of the sheet S, a fixing device 9 is provided. To the sheet S fed to the fixing device 9, predetermined pressure and predetermined heat quantity are applied from the fixing device 9, so that the toner image is melt-fixed on a surface of the sheet S. The sheet S on which the image is fixed in the above-described manner is discharged onto a discharge tray 601 as it is by normal rotation of a discharging roller pair 69.

In the case where double-side image formation is carried out, after the sheet S is fed by the normal rotation of the discharging roller pair 69 until a trailing end thereof passes through a flapper 602, the discharging roller pair 69 is reversely rotated. As a result, leading and trailing ends of the sheet S are replaced with each other, and the sheet S is fed to a feeding path 603 for the double-side image formation. Thereafter, the sheet S is fed to the feeding path 64 by a re-feeding roller pair 604 in synchronism with subsequent image forming timing.

(Image Forming Process)

During image formation, the photosensitive drum 1 is rotationally driven by a motor. The charging roller 2 charges the surface of the rotationally driven photosensitive drum 1 uniformly in advance. An exposure device 68 forms an electrostatic latent image on the surface of the photosensitive drum 1 charged by the charging roller 2, on the basis of a signal of image information inputted to the image forming apparatus 60. The photosensitive drum 1 is capable of permitting formation of electrostatic latent images of a plurality of sizes.

The developing device 3 includes a rotatable developing sleeve 70 as a developer carrying member for carrying the developer. The developing device 3 develops the electrostatic latent image, formed on the surface of the photosensitive drum 1, with the developer carried on the surface of the developing sleeve 70. As a result, the toner is deposited on an exposed portion on the surface of the photosensitive drum 1, so that the electrostatic latent image is visualized as a visible image (toner image). To the primary transfer roller 4, a transfer bias (electrostatic load bias) is applied, so that the toner image formed on the surface of the photosensitive drum 1 is transferred onto the intermediary transfer belt 61. Toner (transfer residual toner) remaining in a slight amount on the surface of the photosensitive drum 1 after the primary transfer is collected by the photosensitive member cleaner 5, and prepares for a subsequent image forming process.

The image forming processes, for the respective colors, which are performed in parallel by the image forming portions 600 for the respective colors of Y, M, C and Bk are carried out at timings when an associated toner image is successively transferred superposedly onto the toner image for the color on an upstream image forming portion side. As a result, a full-color toner image is formed on the intermediary transfer belt 61, so that the toner image is fed to the secondary transfer nip. To the outer secondary transfer roller 67, a transfer bias is applied, so that the toner image formed on the intermediary transfer belt 61 is transferred onto the sheet S fed to the secondary transfer nip. Toner (transfer residual toner) slightly remaining on the intermediary transfer belt 61 after the sheet S passed through the secondary transfer nip is collected by the intermediary transfer member cleaner 8. The fixing device 9 fixes the toner image transferred on the sheet. The sheet (recording material) S on which the toner image is fixed is discharged onto a discharge tray 601.

A series of image forming processes as described above is ended and then the image forming apparatus 60 prepares for a subsequent image forming operation.

(Structure of Developing Device)

Figure 2:
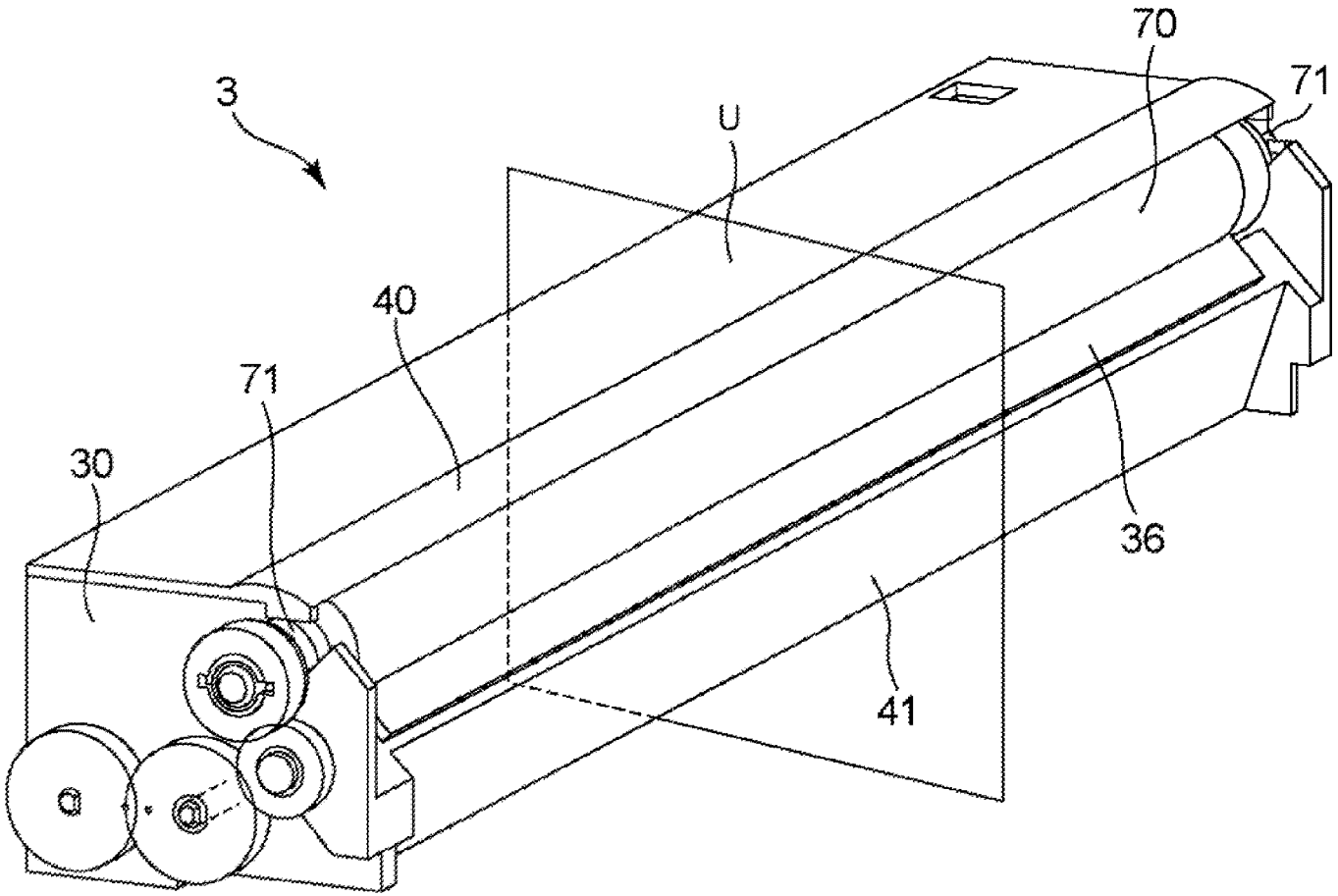
FIG. 2 is a perspective view showing a structure of a developing device.
Figure 3:
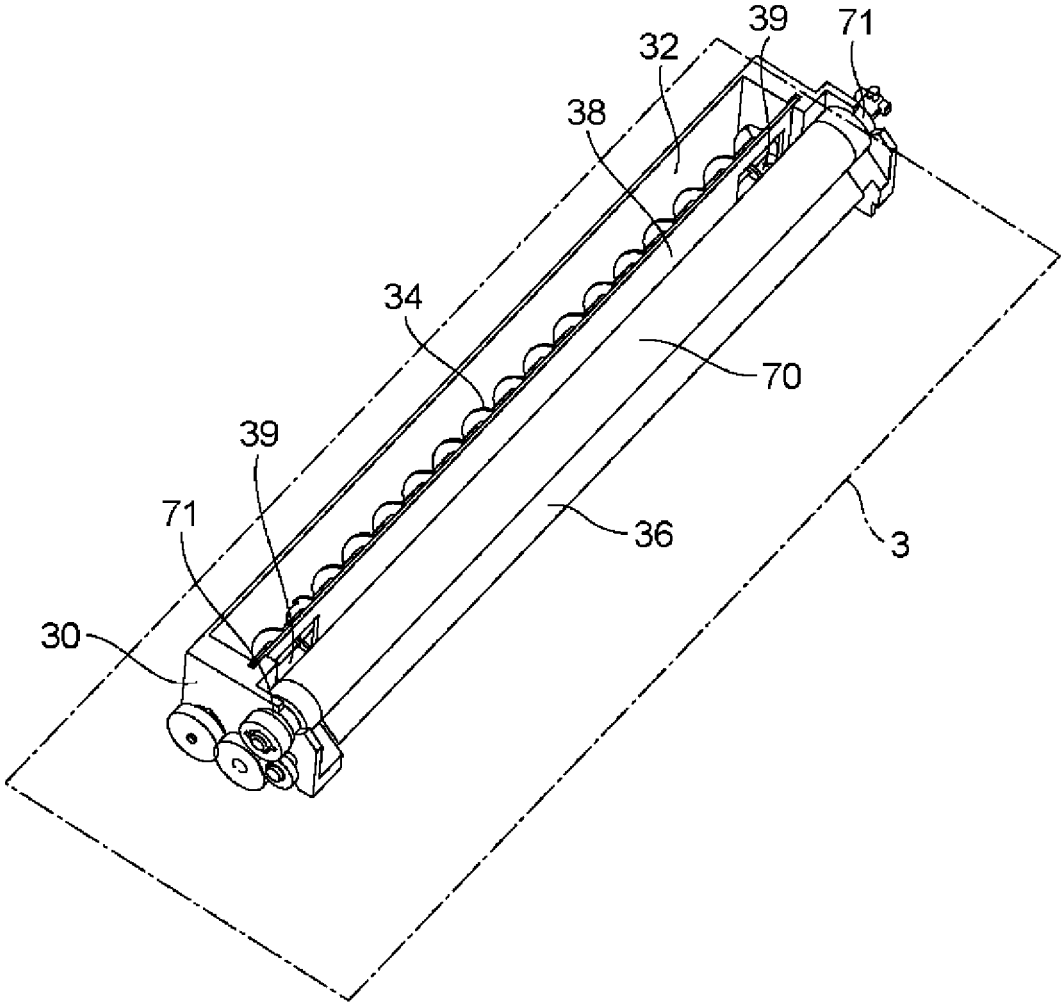
FIG. 3 is a perspective view showing a structure of the developing device.
Figure 4:
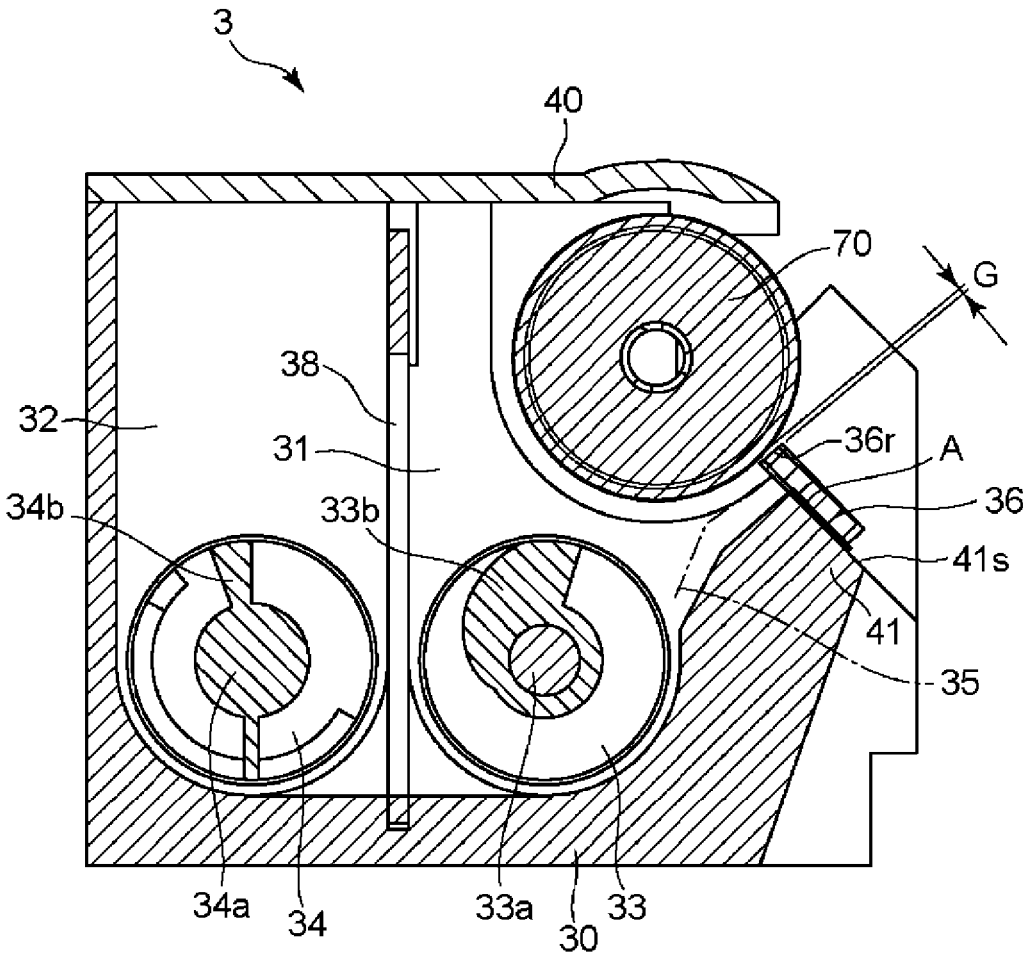
FIG. 4 is a sectional view showing a structure of the developing device.

A general structure of the developing device 3 will be described with reference to perspective views of FIGS. 2 and 3 and a sectional view of FIG. 4, FIG. 4 is the sectional view of the developing device 3 at a cross-section U of FIG. 2.

The developing device 3 includes a resin-made developing device frame 30 molded with a resin material and the developing container 50 which is formed separately from the developing device frame 30 and which is constituted by a resin-made cover frame 40 molded with a resin material. FIG. 2 and FIG. 4 show a state in which the cover frame 40 is mounted on the developing device frame 30, and FIG. 3 shows a state in which the cover frame 40 is not mounted on the developing device frame 30. Incidentally, details of the developing device frame 30 (alone) will be described later with reference to FIG. 6.

The developing container 50 is provided with an opening at a position corresponding to the developing region where the developing sleeve 70 opposes the photosensitive drum 1. At the opening of the developing container 50, the developing sleeve 70 is disposed rotatably relative to the developing container 50 so that a part of the developing sleeve 70 exposes. At each of end portions of the developing sleeve 70, a bearing 71 as a bearing member is provided.

An inside of the developing container 50 is partitioned (sectioned) into a developing chamber 31 as a first chamber and a stirring chamber 32 as a second chamber by a partition wall 38 extending in a vertical direction. The developing chamber 31 and the stirring chamber 32 are connected with each other at longitudinal end portions through two communicating portions 39 provided in the partition wall 38. For that reason, between the developing chamber 31 and the stirring chamber 32, the developer can move through the communicating portions 39. The developing chamber 31 and the stirring chamber 32 are arranged with respect to a horizontal direction.

Inside the developing sleeve 70, a magnet roll, including a plurality of magnetic poles along a rotational direction of the developing sleeve 70, as a magnetic field generating means for generating a magnetic field for carrying the developer on the surface of the developing sleeve 70 is fixedly provided. The developer in the developing chamber 31 is scooped by the influence of the magnetic field of the magnetic pole of the magnetic roll, and is supplied to the developing sleeve 70. Thus, the developer is supplied from the developing chamber 31 to the developing sleeve 70, and therefore, the developing chamber 31 is also referred to as a supplying chamber.

In the developing chamber 31, a first feeding screw 33 as a feeding means for stirring and feeding the developer in the developing chamber 31 is provided opposed to the developing sleeve 70. The first feeding screw 33 includes a rotation shaft 33*a* as a rotatable shaft portion and a helical blade portion 33*b* as a developer feeding portion provided along an outer periphery of the rotation shaft 33*a*, and is supported rotatably relative to the developing container 50. At each of end portions of the rotation shaft 33*a*, a bearing member is provided.

Further, in the stirring chamber 32, a second feeding screw 34 as a feeding means for stirring and feeding the developer in the stirring chamber 32 in a direction opposite to a developer feeding direction of the first feeding screw 33 is provided. The second feeding screw 34 includes a rotation shaft 34*a* as a rotatable shaft portion and a helical blade portion 34*b* as a developer feeding portion provided along an outer periphery of the rotation shaft 34*a*, and is supported rotatably relative to the developing container 50. At each of end portions of the rotation shaft 34*a*, a bearing member is provided. Further, the first feeding screw 33 and the second feeding screw 34 are rotationally driven, whereby a circulating path in which the developer is circulated between the developing chamber 31 and the stirring chamber 32 through the communicating portions 39 is formed.

The developing container 50 is provided with a regulating blade (hereinafter, referred to as a doctor blade) as a developer regulating member for regulating an amount (also referred to as a developer coating amount) of the developer carried on the surface of the developing sleeve 70 so as to oppose the surface of the developing sleeve 70 in contact with the surface of the developing sleeve 70. The doctor blade 36 includes a coating amount regulating surface 36*r* as a regulating portion for regulating an amount of the developer carried on the developing sleeve 70. The doctor blade 36 is a resin-made doctor blade molded with a resin material. Incidentally, a structure of the doctor blade 36 (alone) will be described with reference to FIG. 5.

The doctor blade 36 is disposed opposed to the developing sleeve 70 via a predetermined gap (hereinafter, referred to as an SB gap) G between itself and the developing sleeve 70 over a longitudinal direction of the developing sleeve 70 (i.e., a direction parallel to a rotational axis of the developing sleeve 70). In the present invention, the SB gap G is a minimum distance between a maximum image region of the developing sleeve 70 and a maximum image region of the doctor blade 36. Incidentally, the maximum image region of the developing sleeve 70 refers to a region of the developing sleeve 70 corresponding to a maximum image region of an image region in which the image is formable on the surface of the photosensitive drum 1, with respect to the rotational axis of the developing sleeve 70. Further, the maximum image region of the doctor blade 36 refers to a region of the doctor blade 36 corresponding to the maximum image region of the image region in which the image is formable on the surface of the photosensitive drum 1, with respect to the rotational axis direction of the developing sleeve 70. In First Embodiment, electrostatic latent images having a plurality of sizes are formable on the photosensitive drum 1, and therefore, the maximum image region refers to an image region corresponding to a largest size (for example, A3 size) of the plurality of sizes in which the electrostatic latent images are formable on the photosensitive drum 1. On the other hand, in a modified example in which the electrostatic latent image having only one size is formable on the photosensitive drum 1, the maximum image region is read as an image region having the only one size in which the electrostatic latent image is formable on the photosensitive drum 1.

The doctor blade 36 is disposed substantially opposed to a peak position of magnetic flux density of the magnetic pole of the magnet roll. The developer supplied to the developing sleeve 70 is influenced by the magnetic field of the magnetic pole of the magnet roll. Further, the developer regulated and scraped off by the doctor blade 36 tends to stagnate at a portion upstream of the SB gap G. As a result, a developer stagnating portion is formed on a side upstream of the doctor blade 36 with respect to the rotational direction of the developing sleeve 70. Then, a part of the developer stagnating at the developer stagnating portion is fed so as to pass temperature the SB gap with rotation of the developing sleeve 70. At this time, a layer thickness of the developer passing through the SB gap G is regulated by a coating amount regulating surface 36*r* of the doctor blade 36. Thus, a thin layer of the developer is formed on the surface of the developing sleeve 70.

Then, the developer carried in a predetermined amount on the surface of the developing sleeve 70 is fed to the developing region with the rotation of the developing sleeve 70. Therefore, by adjusting a magnitude of the SB gap G, the amount of the developer fed to the developing region is adjusted. In First Embodiment, when the magnitude of the SB gap G is adjusted, a target magnitude of the SB gap G (so-called target value of the SB gap G) is set at about 300 μm.

The developer fed to the developing region is magnetically raised in the developing region, so that magnetic chains are formed. By contact of the magnetic chains with the photosensitive drum 1, the toner in the developer is supplied to the photosensitive drum 1. Then, the electrostatic latent image formed on the surface of the photosensitive drum 1 is developed as the toner image. The developer on the surface of the developing sleeve 70 after passing through the developing region and supplying the toner to the photosensitive drum 1 (hereinafter, this developer is referred to as a developer after the developing step) is scraped off of the surface of the developing sleeve by a repelling magnetic field formed between identical-polarity magnetic poles of the magnet roll. The developer, after the developing step, scraped off of the surface of the developing sleeve 70 drops in the developing chamber 31, and thus is collected in the developing chamber 31.

As shown in FIG. 4, in the developing device frame 30, a developer guiding portion 35 for guiding the developer so as to be fed toward the SB gap G is provided. The developer guiding portion 35 and the developing device frame 30 are integrally formed with each other, and the developing guiding portion 35 and the doctor blade 36 are formed separately from each other. The developer guiding portion 35 is formed inside the developing device frame 30 and is disposed on a side upstream of the coating amount regulating surface 36*r* of the doctor blade 36 with respect to the rotational direction of the developing sleeve 70. A flow of the developer is stabilized by the developer guiding portion 35 and thus a density of the developer is adjusted to provide a predetermined developer density, whereby a weight of the developer at a position where the coating amount regulating surface 36*r* of the doctor blade 36 is closes to the surface of the developing sleeve 70 can be determined.

Further, as shown in FIG. 4, the cover frame 40 is formed as a separate member from the developing device frame 30 and is mounted on the developing device frame 30. Further, the cover frame 40 covers a part of an opening of the developing device frame 30 so as to cover a part of an outer peripheral surface of the developing sleeve 70 over an entire region of the developing sleeve 70 with respect to the longitudinal direction of the developing sleeve 70. At this time, cover frame 40 covers a part of the opening of the developing device frame 40 so that the developing region where the developing sleeve 70 opposes the photosensitive drum 1 exposes. The cover frame 40 is fixed to the developing device frame 30 by ultrasonic bonding, but a fixing method of the developing device frame 40 to the cover frame 40 may also be either one of screw fastening, snap fitting, bonding, welding, or the like. Incidentally, as regards the cover frame 40, as shown in FIG. 4, the cover frame 40 may be constituted by a single part (resin mold product) and may also be constituted by a plurality of parts (resin mold products).

(Structure of Resin-Made Doctor Blade)

The structure of the doctor blade (alone) will be described using a perspective view of FIG. 5.

During the image forming operation (developing operation), pressure of the developer generating from a flow of the developer (hereinafter, this pressure is referred to as developer pressure) is exerted on the doctor blade 36. With decreasing rigidity, when the developer pressure is exerted on the doctor blade 36 during the image forming operation, the doctor blade 36 is liable to deform and there is a tendency that the magnitude of the SB gap G is liable to fluctuate. During the image forming operation, the developer pressure is applied in a widthwise direction (an arrow M direction of FIG. 5) of the doctor blade 36. Therefore, in order to suppress a fluctuation in magnitude of the SB gap during the image forming operation, it is desirable that the doctor blade 36 is made strong against deformation with respect to the widthwise direction thereof by increasing the rigidity of the doctor blade 36 with respect to the widthwise direction.

Figure 5:
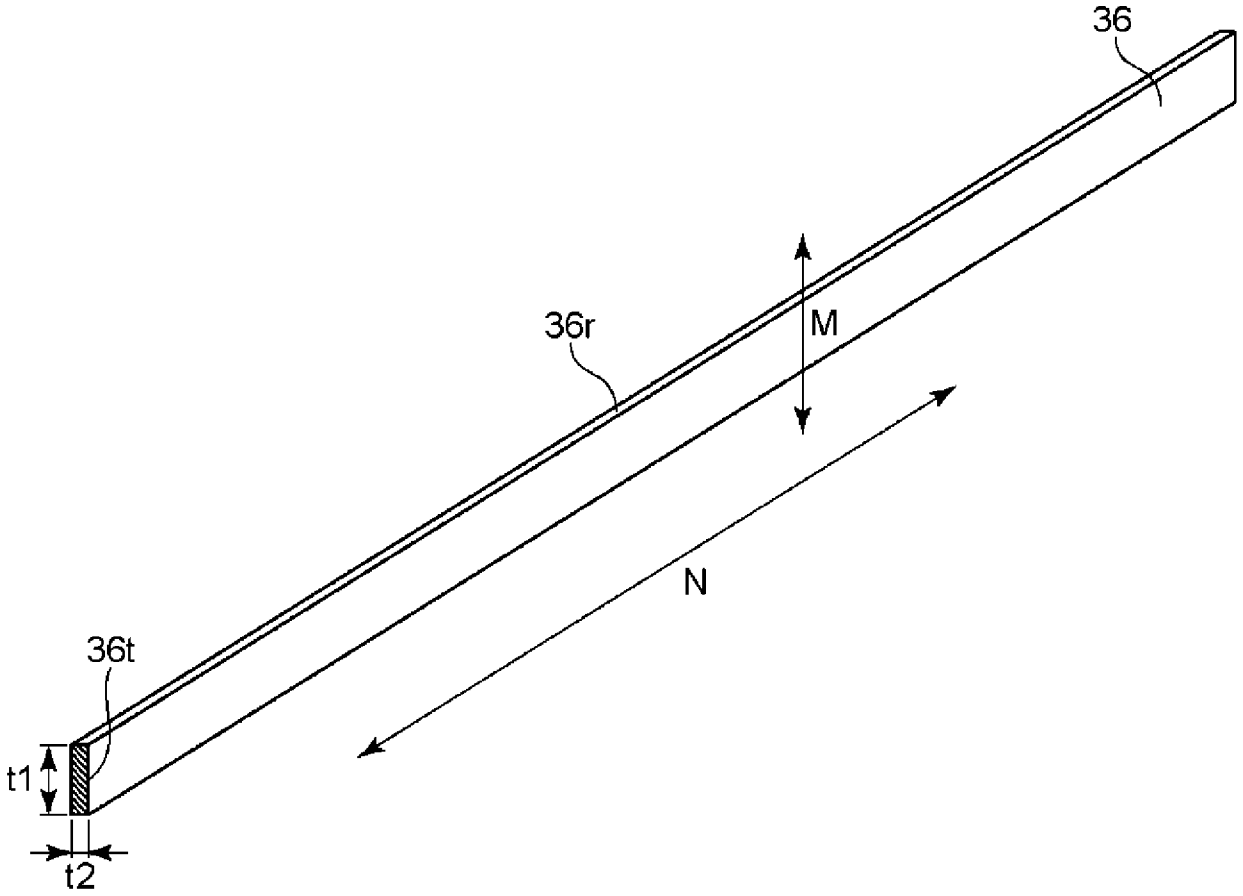
FIG. 5 is a perspective view showing a structure of a resin-made doctor blade (alone).

As shown in FIG. 5, a shape of the doctor blade 36 is a plate shape from viewpoints of mass production and a cost. Further, as shown in FIG. 5, a cross-sectional area of a side surface 36*t* of the doctor blade 36 is made small, and a length $t_2$ of the doctor blade 36 with respect to a thickness direction is made smaller than a length $d_1$ of the doctor blade 36 with respect to a widthwise direction of the doctor blade 36. As a result, the doctor blade 36 (alone) has a constitution in which the doctor blade 36 is liable to deform in a direction (an arrow M direction of FIG. 5) perpendicular to the longitudinal direction (an arrow N direction of FIG. 5) of the doctor blade 36. Therefore, in order to correct straightness of the coating amount regulating surface 36*r*, in a state in which at least a part of the doctor blade 36 is flexed in the arrow M direction of FIG. 5, the doctor blade 36 is fixed to a blade mounting portion 41 of the developing device frame 30. Incidentally, details of correction of the straightness will be described later with reference to FIG. 11 and subsequent figures (particularly FIG. 12).

(Structure of Resin-Made Developing Device Frame)

Figure 6:
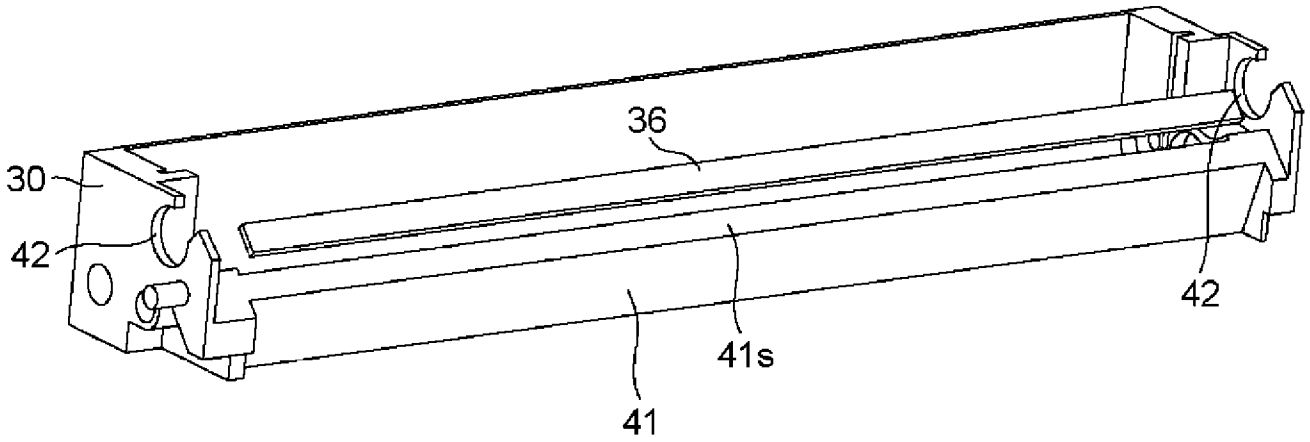
FIG. 6 is a perspective view showing a structure of a resin-made developing device frame (alone).

The structure of the developing device frame 30 (alone) will be described using a perspective view of FIG. 6. FIG. 6 shows a state in which the cover frame 40 is not mounted on the developing device frame 30.

The developing device frame 30 includes the developing chamber 31 and the stirring chamber 32 which is partitioned from the developing chamber 31 by the partition wall 38. The partition wall 38 is molded with a resin material, and may also be formed separately from the developing device frame 30 and may also be formed integrally with the developing device frame 30.

The developing device frame 30 includes a sleeve supporting portion 42 for rotatably supporting the developing sleeve 70 by supporting the bearings 71 provided at the longitudinal end portions of the developing sleeve 70. The developing device frame 30 further includes the blade mounting portion 41, formed integrally with the sleeve supporting portion 42, for mounting the doctor blade 36. FIG. 6 shows a phantom state in which the doctor blade 36 is caused to float from the blade mounting portion 41.

In a state in which the doctor blade 36 is mounted on the blade mounting portion 41, an adhesive A applied onto a blade mounting surface 41*s* of the blade mounting portion 41 is cured, so that the doctor blade 36 is fixed on the blade mounting portion 41. Details of the method of fixing the doctor blade 36 to the blade mounting portion 41 will be described later with reference to FIG. 11 and subsequent figures (particularly FIGS. 13 and 14).

(Rigidity of Resin-Made Doctor Blade)

The rigidity of the doctor blade 36 (alone) will be described using a schematic view of FIG. 7. The rigidity of the doctor blade 36 is measured in a state in which the doctor blade 36 is not fixed on the blade mounting portion 41 of the developing device frame 30.

Figure 7:
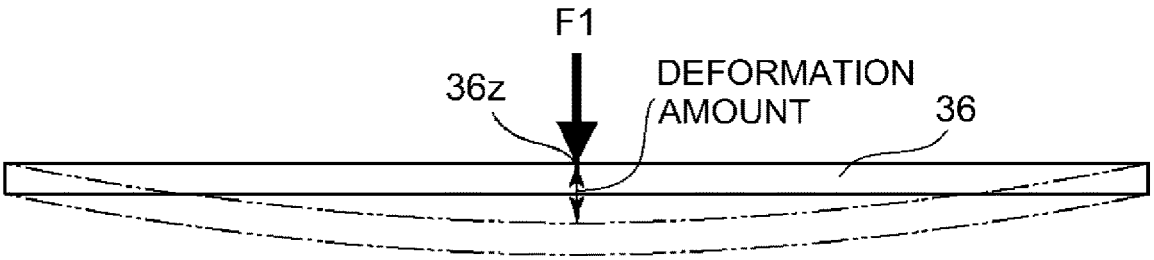
FIG. 7 is a schematic view for illustrating rigidity of the resin-made doctor blade (alone).

As shown in FIG. 7, a concentrated load F1 is exerted in the widthwise direction of the doctor blade 36 on a central portion 36*z* of the doctor blade 36 with respect to the longitudinal direction of the doctor blade 36. At this time, the rigidity of the doctor blade 36 (alone) is measured on the basis of an amount of flexure of the doctor blade 36 in the widthwise direction at the central portion 36*z* of the doctor blade 36.

For example, it is assumed that the concentrated load F1 of 300 gf is exerted in the widthwise direction of the doctor blade 36 on the central portion 36*z* of the doctor blade 36 with respect to the longitudinal direction of the doctor blade 36. At this time, at the central portion 36*z* of the doctor blade 36, the amount of flexure of the doctor blade 36 in the widthwise direction is 700 μm or more. Incidentally, at this time, an amount of deformation in cross-section of the doctor blade 36 at the central portion 36*z* is 5 μm or less.

(Rigidity of Resin-Made Developing Device Frame)

The rigidity of the developing device frame 30 (alone) will be described using a schematic view of FIG. 8. The rigidity of the developing device frame 30 is measured in a state in which the doctor blade 36 is not fixed on the blade mounting portion 41 of the developing device frame 30.

Figure 8:
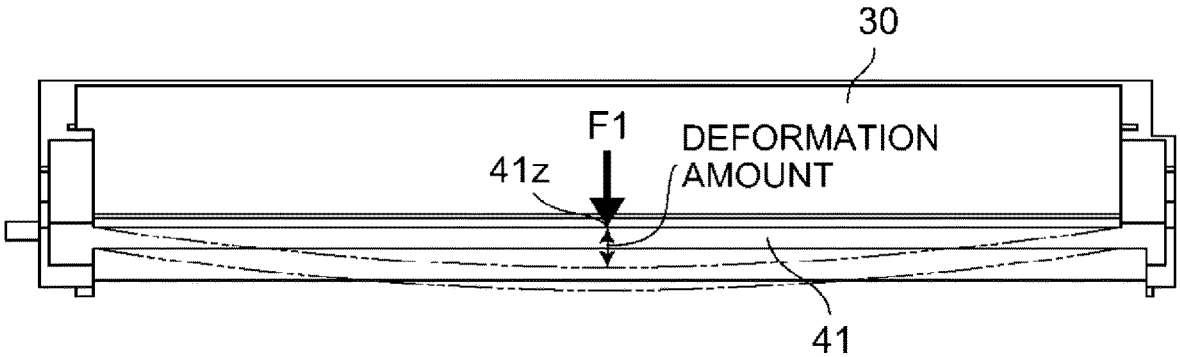
FIG. 8 is a schematic view for illustrating rigidity of the resin-made developing device frame (alone).

As shown in FIG. 8, a concentrated load F1 is exerted in the widthwise direction of the blade mounting portion 41 on a central portion 41*z* of the blade mounting portion 41 with respect to the longitudinal direction of the blade mounting portion 41. At this time, the rigidity of the developing device frame 30 (alone) is measured on the basis of an amount of flexure of the blade mounting portion 41 in the widthwise direction at the central portion 41*z* of the blade mounting portion 41.

For example, it is assumed that the concentrated load F1 of 300 gf is exerted in the widthwise direction of the blade mounting portion 41 on the central portion 41*z* of the blade mounting portion 41 with respect to the longitudinal direction of the blade mounting portion 41. At this time, at the central portion 41*z* of the blade mounting portion 41, the amount of flexure of the blade mounting portion 41 in the widthwise direction is 60 μm or less.

It is assumed that the same concentrated load F1 in magnitude is exerted on each of the central portion 36*z* of the doctor blade 36 and the central portion 41*z* of the blade mounting portion 41. At this time, the amount of flexure of the doctor blade 36 at the central portion 36*z* is not less than 10 times higher than the amount of flexure of the blade mounting portion 41 at the central portion 41*z*. Therefore, the rigidity of the developing device frame 30 (alone) is not less than 10 times higher than the rigidity of the doctor blade 36 (alone). For that reason, in a state in which the doctor blade 36 is mounted on the blade mounting portion 41 of the developing device frame 30 and is fixed on the blade mounting portion 41 of the developing device frame 30, compared with the rigidity of the doctor blade 36, the rigidity of the developing device frame 30 is predominant. Further, in the case where the doctor blade 36 is fixed on the developing device frame 30 over an entire area of the maximum image region, compared with the case where the doctor blade 36 is fixed on the developing device frame 30 only at the longitudinal end portions, the rigidity of the doctor blade 36 in a state in which the doctor blade 36 is fixed on the developing device frame 30 becomes high.

Further, the rigidity of the developing device frame 30 (alone) is larger than the rigidity of the cover frame 40 (alone). For that reason, in a state in which the cover frame 40 is mounted on the developing device frame 30 and is fixed to the developing device frame 30, compared with the rigidity of the cover frame 40, the rigidity of the developing device frame 30 is predominant.

(Adhesive)

As regards selection of the adhesive A, there is a need that the adhesive A has adhesive strength to an extent that the doctor blade 36 is not peeled off of the blade mounting surface 41*s* of the developing device frame 30 during the image forming operation (developing operation). A load exerted on the doctor blade 36 during the image forming operation (developing operation) is about 2 kgf during a drop test, and there is no problem when the doctor blade 36 is not peeled off of the blade mounting surface 41*s* of the developing device frame 30 under the load. For that reason, it is known that the adhesive strength can be sufficiently ensured when the adhesive A is a general-purpose adhesive, and from a viewpoint of ensuring mass-production, a curing time of the adhesive A may preferably be short to the extent possible.

Then, a (film) thickness of the adhesive A applied onto the blade mounting surface 41*s* of the developing device frame 30 will be described. The doctor blade 36 and the blade mounting surface 41*s* of the developing device frame 30 are bonded together with the adhesive A, and therefore, the adhesive A is interposed between the doctor blade 36 and the blade mounting surface 41*s* of the developing device frame 30. For that reason, there is a need to consider the thickness of the adhesive A applied onto the blade mounting surface 41*s* so that the adhesive A interposed between the doctor blade 36 and the blade mounting surface 41*s* of the developing device frame 30 does not have the influence on the magnitude of the SB gap G.

A relationship between the thickness of the adhesive A and a magnitude of a breaking load of a portion bonded by the adhesive A is such that the adhesive strength by the adhesive A is larger with an increasing amount of the adhesive A. As described above, a magnitude of the load exerted on the doctor blade 36 during the image forming operation (developing operation) is about 2 kgf, so that in this embodiment, strength required as the adhesive strength is set at 10 kgf or more with a tolerance. Therefore, in order to ensure 10 kgf or more as the adhesive strength of the adhesive A, the thickness of the adhesive A applied onto the blade mounting surface 41*s* of the developing device frame 30 may only be required to be 20 μm or more.

Then, a relationship between the thickness in which the adhesive A is applied and a magnitude of a dimensional fluctuation of the adhesive A with respect to a thickness direction will be described. In general, with an increasing thickness of the adhesive A, the dimensional fluctuations of the adhesive A with respect to the thickness direction due to contraction of the adhesive A when the adhesive A is cured is liable to occur. On the other hand, the magnitude of the dimensional fluctuation of the adhesive A with respect to the thickness direction when the thickness of the adhesive A is 150 μm is merely about 8 μm larger than the magnitude of the dimensional fluctuation of the adhesive A with respect to the thickness direction when the thickness of the adhesive A is 30 μm. When a difference in magnitude of the dimensional fluctuation of the adhesive A with respect to the thickness direction is about 8 μm, the difference is a negligible level as the influence of the dimensional fluctuation with respect to a direction (i.e, a direction defining the SB gap G) perpendicular to the thickness direction of the adhesive A. Accordingly, an upper limit of the thickness of the adhesive A applied onto the blade mounting surface 41*s* of the developing device frame 30 is not determined in view of the influence of the contraction of the adhesive A but may only be required to be determined depending on an individual manufacturing requirement such as a curing time or a cost of the adhesive A.

(Linear Expansion Coefficient)

Then, deformation of the doctor blade 36 and the developing device frame due to a change in temperature by heat generated during the image forming operation will be described using a perspective view of FIG. 9. As heat generating during the image forming operation, for example, there are heat generating during rotation of the rotation shaft of the developing sleeve 70 and the bearing 71, heat generating during rotation of the rotation shaft 33*a* of the first feeding screw 33 and the bearing member thereof, and heat generating when the developer passes through the SB gap G, and the like. By the heat generated during the image forming operation, an ambient temperature of the developing device 3 changes, so that temperatures of the doctor blade 36, the developing device frame 30 and the cover frame 40 also change.

Figure 9:
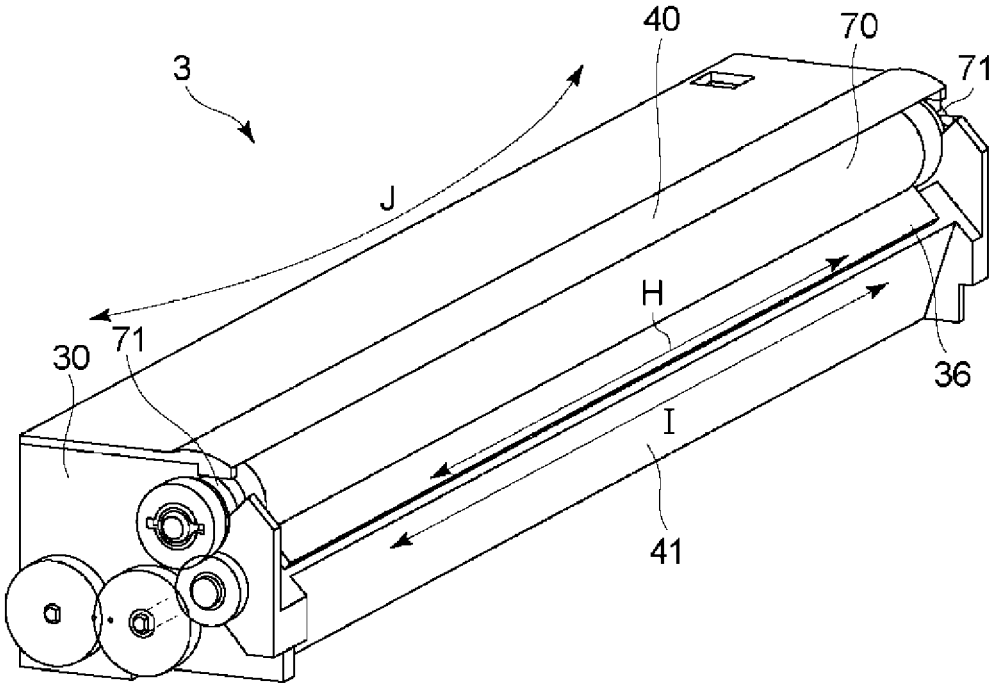
FIG. 9 is a perspective view for illustrating deformation of the resin-made doctor blade due to a temperature change.

As shown in FIG. 9, an elongation amount of the doctor blade 36 due to the temperature change is H (μm), and an elongation amount of the blade mounting surface 41*s* of the blade mounting portion 41 of the developing device frame 30 is I (μm). Further, a linear expansion coefficient α1 of the resin material constituting the doctor blade 36 and a linear expansion coefficient α2 of the resin material contacting the developing device frame 30 are different from each other. In this case, due to a difference between these linear expansion coefficients, deformation amounts of the developing device frame 30 and the doctor blade 36 by the temperature changes are different from each other, so that in order to eliminate a difference between H (μm) and I (μm), the doctor blade 36 deforms in an arrow J direction of FIG. 9. The deformation of the doctor blade 36 in the arrow J direction of FIG. 9 is referred to as deformation of the doctor blade 36 in a warping direction. Further, the deformation of the doctor blade 36 in the warping direction leads to a fluctuation in magnitude of the SB gap G. In order to suppress the fluctuation in magnitude of the SB gap G resulting from the heat, the linear expansion coefficient α2 of the resin material constituting the sleeve supporting portion 42 and the blade mounting portion 41 of the developing device frame 30 (alone) and the linear expansion coefficient α1 of the resin material constituting the doctor blade 36 (alone) are associated with each other. That is, in the case where the linear expansion coefficient α1 of the resin material constituting the doctor blade 36 and the linear expansion coefficient α2 of the resin material constituting the developing device frame 30 are different from each other, due to the difference between these linear expansion coefficients, an amount of a change resulting from the temperature change varies.

In general, the resin material is larger in linear expansion coefficient than the metal material. In the case where the doctor blade 36 is made of the resin material, with the temperature change by the heat generating during the image forming operation, the warping deformation of the doctor blade 36 occurs, so that the doctor blade 36 is liable to flex at the longitudinal central portion. As a result, in the photosensitive drum in which the resin-made doctor blade 36 is fixed to the resin-made developing device frame, the magnitude of the SB gap G is liable to fluctuate with the temperature change during the image forming operation.

In order to correct the straightness of the coating amount regulating surface 36*r* to not more than 50 μm, the doctor blade 36 is flexed in at least the part of the maximum image region thereof. Further, a method in which the doctor blade 36 flexed in at least the part of the maximum image region is fixed to the blade mounting portion 41 of the developing device frame 30 with the adhesive A over the entire area of the maximum image region of the doctor blade 36 is employed.

At this time, in the case where there is a large difference between the linear expansion coefficient α2 of the resin material constituting the developing device frame 30 and the linear expansion coefficient α1 of the resin material constituting the doctor blade 36, when the temperature change occurs, the following problem arises. That is, when the temperature change occurs, a deformation amount (expansion/contraction amount) of the doctor blade 36 due to the temperature change and a deformation amount (expansion/contraction amount) of the developing device frame 30 due to the temperature change are different from each other. As a result, even in the case where the SB gap G is adjusted with high accuracy when the position where the doctor blade 36 is mounted on the blade mounting surface 41*s* of the developing device frame 30 is determined, the magnitude of the SB gap G is fluctuated due to the temperature change during the image forming operation.

The doctor blade 36 is fixed to the blade mounting surface 41*s* over the entire area of the maximum image region, and therefore, there is a need to suppress the fluctuation in magnitude of the SB gap G resulting from the temperature change during the image forming operation. As regards the fluctuation amount of the SB gap G due to the heat, with respect to the longitudinal direction of the developing sleeve 70, in order to suppress non-uniformity of the amount of the developer carried on the surface of the developing sleeve 70, there is a need to suppress the fluctuation amount to not more than ±20 am in general.

A difference of the linear expansion coefficient α2 of the resin material constituting the developing device frame 30 including the sleeve supporting portion 42 and the blade mounting portion 41 from the linear expansion coefficient α1 of the resin material constituting the doctor blade 36 is hereinafter referred to as a linear expansion coefficient difference (α2−α1). A change in maximum flexure amount of the doctor blade 36 due to this linear expansion coefficient difference (α2−α1) will be described using Table 1. In a state in which the doctor blade 36 was fixed to the blade mounting portion 41 of the developing device frame 30 over the entire area of the maximum image region of the doctor blade 36, measurement of the maximum flexure amount of the doctor blade when the temperature change from a normal temperature (23° C.) to a high temperature (40° C.) was made was carried out.

The linear expansion coefficient of the resin material constituting the developing device frame 30 including the sleeve supporting portion 42 and the blade mounting portion 41 is α2 (m/° C.), and the linear expansion coefficient of the resin material constituting the doctor blade 36 is α1 (m/° C.). Then, the linear expansion coefficient difference (α2−α1) was changed, and the maximum flexure amount of the doctor blade 36 was measured. A result thereof is shown in Table 1. In Table 1, in the case where the absolute value of the maximum flexure amount is not more than 20 μm, the maximum flexure amount is evaluated as "o", and in the case where the absolute value of the maximum flexure amount is larger than 20 μm, the maximum flexure amount is evaluated as "x".

TABLE 1

| $\alpha 2 - \alpha 1$ [$\times 10^{-5}$ m/° C.] | MFA*1 |
|---|---|
| 0 | o |
| +0.20 | o |
| +0.40 | o |
| +0.50 | o |
| +0.54 | o |
| +0.55 | o |
| +0.56 | x |
| +0.57 | x |
| +0.60 | x |
| 0 | o |
| −0.20 | o |
| −0.40 | o |
| −0.44 | o |
| −0.45 | o |
| −0.46 | x |
| −0.47 | x |
| −0.50 | x |

*1"MFA" is the maximum flexure amount of the doctor blade.

As is understood from Table 1, in order to suppress the fluctuation amount of the SB gap G due to the heat to not more than ±20 μm, there is a need that the linear expansion coefficient difference ($\alpha 2-\alpha 1$) satisfies the following relationship (1):

$$-0.45\times10^{-5}\ (\text{m/° C.})\leq\alpha 2-\alpha 1\leq 0.55\times10^{-5}\ (\text{m/° C.}) \quad (1).$$

Therefore, the resin material constituting the developing device frame 30 and the resin material constituting the doctor blade 36 may only be required to be selected so that the linear expansion coefficient difference ($\alpha 2-\alpha 1$) is $-0.45\times10^{-5}$ (m/° C.) or more and $0.55\times10^{-5}$ (m/° C.) or less. Incidentally, the same resin material is selected as the resin material constituting the developing device frame 30 and the resin material constituting the doctor blade 36, the linear expansion coefficient difference ($\alpha 2-\alpha 1$) becomes zero.

Incidentally, when the adhesive A is applied onto the doctor blade 36 and the developing device frame 30, the doctor blade 36 and the developing device frame 30 on which the adhesive A is applied fluctuated fluctuate in linear expansion coefficient. However, a volume itself of the adhesive A applied onto the doctor blade 36 and the developing device frame 30 is very small, so that the influence thereof on a dimensional fluctuation due to the temperature change with respect to a thickness direction of the adhesive A is at a negligible level. For that reason, when the adhesive A is applied onto the doctor blade 36 and the developing device frame 30, the deformation of the doctor blade 36 in the warping direction due to the fluctuation in linear expansion coefficient difference ($\alpha 2-\alpha 1$) is at a negligible level.

Similarly, the cover frame 40 is fixed to the developing device frame 30, and therefore, when the deformation amounts of the developing device frame 30 and the cover frame 40 due to the temperature change are different from each other, the deformation of the cover frame 40 in the warping direction heads to the fluctuation in magnitude of the SB gap G. The linear expansion coefficient of the resin material constituting the developing device frame 30 including the sleeve supporting portion 42 and the blade mounting portion 41 is $\alpha 2$ (m/° C.), and the linear expansion coefficient of the resin material constituting the cover frame 40 is $\alpha 3$ (m/° C.). Further, a difference of the linear expansion coefficient $\alpha 3$ of the resin material constituting the cover frame 40 from the linear expansion coefficient $\alpha 2$ of the resin material constituting the developing device frame 30 including the sleeve supporting portion 42 and the blade mounting portion 41 is hereinafter referred to as a linear expansion coefficient difference ($\alpha 3-\alpha 2$).

At this time, similarly as in the case of Table 1, there is a need that the linear expansion coefficient difference ($\alpha 3-\alpha 2$) satisfies the following relationship (2):

$$-0.45\times10^{-5}\ (\text{m/° C.})\leq\alpha 3-\alpha 2\leq 0.55\times10^{-5}\ (\text{m/° C.}) \quad (2).$$

Therefore, the resin material constituting the developing device frame 30 and the resin material constituting the cover frame 40 may only be required to be selected so that the linear expansion coefficient difference ($\alpha 3-\alpha 2$) is $-0.45\times10^{-5}$ (m/° C.) or more and $0.55\times10^{-5}$ (m/° C.) or less. Incidentally, the same resin material is selected as the resin material constituting the developing device frame 30 and the resin material constituting the cover frame 40, the linear expansion coefficient difference ($\alpha 3-\alpha 2$) becomes zero.

(Developer Pressure)

Figure 10:
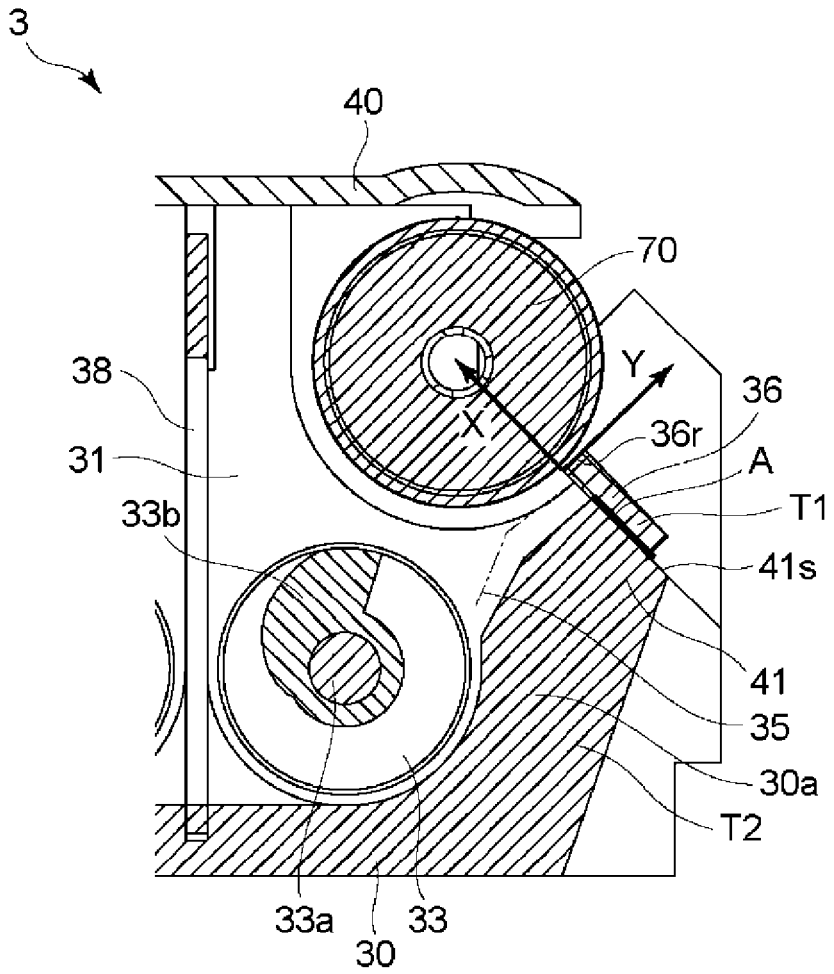
FIG. 10 is a sectional view for illustrating deformation of the resin-made doctor blade due to developer pressure.

Then, the deformation of the doctor blade 36 resulting from application, to the doctor blade 36, of the developer pressure generating from a flow of the developer will be described using a sectional view of FIG. 10. FIG. 10 is the sectional view of the developing device 3 in a cross-section (cross-section U of FIG. 2) perpendicular to the rotational axis of the developing sleeve 70. Further, FIG. 10 shows a structure of a neighborhood of the doctor blade 36 fixed to the blade mounting portion 41 of the developing device frame 30 with the adhesive A.

As shown in FIG. 10, a line connecting a closest position of the doctor blade 36 to the developing sleeve 70 on the coating amount regulating surface **36*r* is X-axis. At this time, the doctor blade 36 is long in length with respect to the X-axis and is high in rigidity in cross-section along the X-axis. Further, as shown in FIG. 10, a proportion of a cross-sectional area T1 of the doctor blade 36 to a cross-sectional area T2 of a wall portion 30*a* of the developing device frame 30 positioned in the neighborhood of the developer guiding portion 35** is small.

As described above, the rigidity of the developing device frame 30 (alone) is made higher than the rigidity of the doctor blade 36 (alone) by ten times or more. Accordingly, in a state in which the doctor blade 36 is fixed to the blade mounting portion 41 of the developing device frame 30, the rigidity of the developing device frame 30 is predominant over the rigidity of the doctor blade 36. As a result, during the image forming operation, a displacement amount (maximum flexure amount) of the coating amount regulating surface **36*r* of the doctor blade 36 when the developer pressure is applied to the doctor blade 36 is substantially equivalent to a displacement amount (maximum flexure amount) of the developing device frame 30**.

During the image forming operation, the developer scooped from the first feeding screw 33 passes through the developer guiding portion 35 and is fed to the surface of the developing sleeve 70. Thereafter, even when a layer thickness of the developer is regulated to the magnitude of the SB gap G by the doctor blade 36, the doctor blade 36 is subjected to the developer pressure from various directions. As shown in FIG. 10, when a direction perpendicular to the X-axis direction (a direction in which the SB gap G is defined) is a Y-axis direction, the developer pressure along the Y-axis direction is perpendicular to the blade mounting surface 41*s* of the developing device frame 30. That is, the developer pressure with respect to the Y-axis direction is a force for peeling off the doctor blade 36 of the blade mounting surface 41*s*. Therefore, a binding force by the adhesive A is required to be sufficiently larger than the developer pressure with respect to the Y-axis direction. Therefore, in consideration of the force for peeling off the doctor blade 36 of the blade mounting surface 41*s* by the developer pressure and of an adhesive force of the adhesive A, an adhesive area and application thickness of the adhesive A onto the blade mounting surface 41*s* are optimized.

(Correction of Straightness of Resin-Made Doctor Blade)

Correspondingly to an increase in width of the sheet S such as the case where the width of the sheet S on which the image is to be formed is an A3 size, with respect to a direction parallel to the rotational axis of the developing sleeve 70, a length of the maximum image region of the image region in which the image is formable on the surface of the photosensitive drum 1 becomes large. For that reason, the length of the maximum image region of the doctor blade 36 becomes large correspondingly to the increase in width of the sheet S on which the image is to be formed. In the case where the doctor blade large in longitudinal length is molded with a resin material, it is difficult to ensure the straightness of the coating amount regulating surface of the doctor blade made of resin material. This is because in the case where the doctor blade large in longitudinal length is molded with the resin material, when the thermally expanded resin material thermally contracts, depending on the longitudinal position of the doctor blade, portions where the thickness advances and delays are liable to generate.

For that reason, as regards the resin-made doctor blade, there is a tendency that with an increasing length of the doctor blade with respect to the longitudinal direction, due to the straightness of the coating amount regulating surface of the doctor blade, the SB gap is liable to becomes different with respect to the longitudinal direction of the developer carrying member. When the SB gap is different with respect to the longitudinal direction of the developer carrying member, there is a liability that with respect to the longitudinal direction of the developer carrying member, non-uniformity of the amount of the developer carried on the surface of the developer carrying member occurs.

For example, in the case where the resin-made doctor blade having a length corresponding to a longitudinal length of an A3-size sheet (hereinafter, this doctor blade is referred to as an A3-size compatible resin-made doctor blade) is manufactured with accuracy of a general purpose resin mold product, the straightness of the coating amount regulating surface is about 300 μm-500 μm. Further, even if the A3-size compatible resin-made doctor blade is manufactured with high accuracy by using a high-accuracy resin material, the straightness of the coating amount regulating surface is about 100 μm-200 μm.

In this embodiment, the magnitude of the SB gap G is set at about 300 μm, and a tolerance of the SB gap G (i.e., a tolerance with respect to the target value of the SB gap G) is set at within ±10%. Therefore, in this embodiment, this means that an adjusting range of the SB gap G is 300 μm±30 μm and that an allowable tolerance of the SB gap G is 60 μm to the maximum. For this reason, even when the A3-size compatible resin-made doctor blade is manufactured with the accuracy of the general purpose resin mold product or is manufactured with high accuracy by using a high-accuracy resin material, only by the accuracy of the straightness of the coating amount regulating surface, a resultant value exceeds an allowable range as the tolerance of the SB gap G.

In the developing device including the resin-made doctor blade, irrespective of the straightness of the coating amount regulating surface, in the state in which the doctor blade is fixed to the mounting portion of the developing device frame, it is desired that the SB gap G falls within a predetermined range over the direction parallel to the rotational axis of the developer carrying member. Therefore, in this embodiment, even when the resin-made doctor blade low in straightness of the coating amount regulating surface, by correcting the straightness of the coating amount regulating surface, in the state in which the doctor blade is fixed to the mounting portion of the developing device frame, the SB gap G is caused to fall within the predetermined range over the direction parallel to the rotational axis of the developing sleeve 70.

Incidentally, by a method described later, whether or not the SB gap G falls within the predetermined range over a direction parallel to the rotational axis of the developing sleeve 70 is discriminated. First, the maximum image region of the doctor blade 36 is equidistantly divided into four or more regions, and in each of the divided regions (but including both end portions and a central portion of the maximum image region of the doctor blade 36), the SB gap G is measured at five places or more. Then, from samples of measured values of the SB gap G measured at five places or more, a maximum value, a minimum value and a median value of the SB gap G are extracted.

At this time, an absolute value of a difference between the maximum value and the median value of the SB gap G may only be required to be not more than 10% of the median value of the SB gap G, and an absolute value of a difference between the minimum value and the median value of the SB gap G may only be required to be not more than 10% of the median value of the SB gap G. In this case, on assumption that the tolerance of the SB gap G is ±10% or less, the SB gap G satisfies that the SB gap G falls within the predetermined range over the direction parallel to the rotational axis of the developing sleeve 70. For example, in the case where from the samples of the measured values of the SB gap G measured a five places or more, the median value of the SB gap G was 300 μm, it may only be required that the maximum value of the SB gap G is 330 μm or less and the minimum value of the SB gap G is 270 μm or more. That is, in this case, an adjusting range of the SB gap G is 300 μm±30 μm, so that as the tolerance of the SB gap G (i.e., the tolerance of the SB gap G to the target value), up to 60 μm at the maximum is permitted.

(Method of Fixing Doctor Blade Made of Resin Material)

Steps of the method of fixing the doctor blade 36 will be described with reference to FIGS. 11 to 14. An external device 100 performs respective steps of the method of fixing the doctor blade 36 described in the following.

First, the device 100 detects an outer configuration of the coating amount regulating surface 36*r* of the doctor blade 36. Then, as regards the outer configuration of the coating amount regulating surface 36*r* with respect to a longitudinal direction of the coating amount regulating surface 36*r*, the device 100 recognizes the straightness of the coating amount regulating surface 36*r* on the basis of a central portion (free end portion 36*e*3 of the doctor blade 36) of the coating amount regulating surface 36*r*. In the steps of the fixing method of the doctor blade 36, a doctor blade which is manufactured of a resin material with accuracy of a general-purpose resin molded product and which is compatible to an A3 size paper (sheet) is used. For that reason, the device 100 recognizes that the straightness of the coating amount regulating surface 36*r* is about 300 μm-500 μm. Then, the device 100 flexes at least a part of a region corresponding to the maximum image region of the doctor blade 36 by a force applied to the doctor blade 36. Then, the device 100 corrects the straightness of the coating amount regulating surface 36r to 50 μm or less (hereinafter, this step is referred to a flexing step).

Then, the device 100 determines, for causing the SB gap G to fall within a predetermined range, a position where the doctor blade flexed at least in a part of the region corresponding to the maximum image region in the flexing step is fixed to the blade mounting portion 41 of the developing device frame 30 (hereinafter, this step is referred to as a positioning step). Then, in a state that the part of the region corresponding to the maximum image region of the doctor blade 36 is flexed, the device 100 fixes the region corresponding to the maximum image region of the doctor blade 36 is flexed, at a predetermined position determined in the positioning step (hereinafter, this step is referred to as a fixing step).

The device 100 includes a mounting table 103 for mounting thereon the doctor blade 36 (alone). Further, the device 100 includes fingers (finger portions) 101 (101p1 to 101p5) provided at fine positions for gripping grip portions 37 (37p1 to 37p5), respectively, provided at five positions in the region corresponding to the maximum image region of the doctor blade 36. The respective fingers 101 (101p1 to 101p5) can independently move in an arrow J direction of FIG. 11, and thus are movable forward and backward with respect to the arrow J direction of FIG. 11.

Further, the device 100 includes cameras 102 (102p1 to 102p5) provided at five positions for measuring positions of free end portions 36e (36e1 to 36e5), of the coating amount regulating surface 36r of the doctor blade 36, provided at five positions. The cameras 102 (102p1 to 102p5) are disposed along a direction (arrow F direction of FIG. 11) toward the free end portions 36e (36e1 to 36e5) of the doctor blade 36. Then, the cameras 102 (102p1 to 102p5) detect the outer configuration of the coating amount regulating surface 36r of the doctor blade 36 by measuring the positions of the free end portions 36e (36e1 to 36e5) of the doctor blade 36. Then, as regards the outer configuration of the coating amount regulating surface 36r with respect to a longitudinal direction of the coating amount regulating surface 36r, the device 100 recognizes the straightness of the coating amount regulating surface 36r on the basis of the central portion (free end portion 36e3 of the doctor blade 36) of the coating amount regulating surface 36r. Incidentally, an example in which the measurement of the positions of the free end portions 36e (36e1 to 36e5) is carried out by the cameras 102 (102p1 to 102p5) will be described in the following, but a modified example in which the measurement is carried out by a non-contact straightness may also be employed.

The doctor blade 36 is manufactured with accuracy of a general-purpose resin molded product. As described above, the A3 size compatible doctor blade made of the resin material is manufactured with the accuracy of the general-purpose resin molded product, the straightness of the coating amount regulating surface is about 300 μm-500 μm. Assuming that the doctor blade 36 is the A3 size compatible resin-made doctor blade manufactured with the accuracy of the general-purpose resin molded product, in a state that the doctor blade 36 is mounted on the mounting table 103, when the five positions of the free end portions 36e (36e1 to 36e5) of the doctor blade 36 are measured thickness the cameras 102 (102p1 to 102p5), a difference of about 300 μm-500 μm generates. On the other hand, in order to suppress non-uniformity of the amount of the developer carried on the surface of the developing sleeve 70 with respect to the longitudinal direction of the developing sleeve 70, the tolerance of the SB gap G is set at ±10% or less.

Therefore, in view of an allowable value of the tolerance of the SB gap and mounting accuracy of the doctor blade 36 on the developing device frame 30, there is a need to correct the straightness of the free end portions 36e1 to 36e5 of the doctor blade 36 (i.e., the straightness of the coating amount regulating surface 36r) to 50 μm or less. Incidentally, in view of the accuracy of the straightness of a doctor blade made of metal is 20 μm or less by secondary cutting (operation), it is preferable that the straightness of the coating amount regulating surface 36r of the doctor blade 36 made of the resin material is corrected to 20 μm or less.

Then, details of a series of steps (the flexing step, the positioning step and the fixing step) of the fixing method of the doctor blade 36 will be described below.

(1) Flexing Step

First, details of the flexing step will be described with reference to a schematic view of FIG. 11. The doctor blade 36 is held by gripping the grip portions 37 (37p1 to 37p5) of the doctor blade 36 with the fingers 101 (101p1 to 101p5). Then, the cameras 102 (102p1 to 102p5) measure the positions of the free end portions 36e (36e1 to 36e5) of the doctor blade 36 in a state that the grip portions 37 (37p1 to 37p5) of the doctor blade 36 are gripped with the fingers 101 (101p1 to 101p5). As a result, the device 100 detects the outer configuration of the coating amount regulating surface 36r of the doctor blade 36. Then, as regards the outer configuration of the coating amount regulating surface 36r with respect to the longitudinal direction of the coating amount regulating surface 36r, the device 100 recognizes the straightness of the coating amount regulating surface 36r on the basis of the central portion (the free end portion 36e3 of the doctor blade 36) of the coating amount regulating surface 36r.

Figure 11:
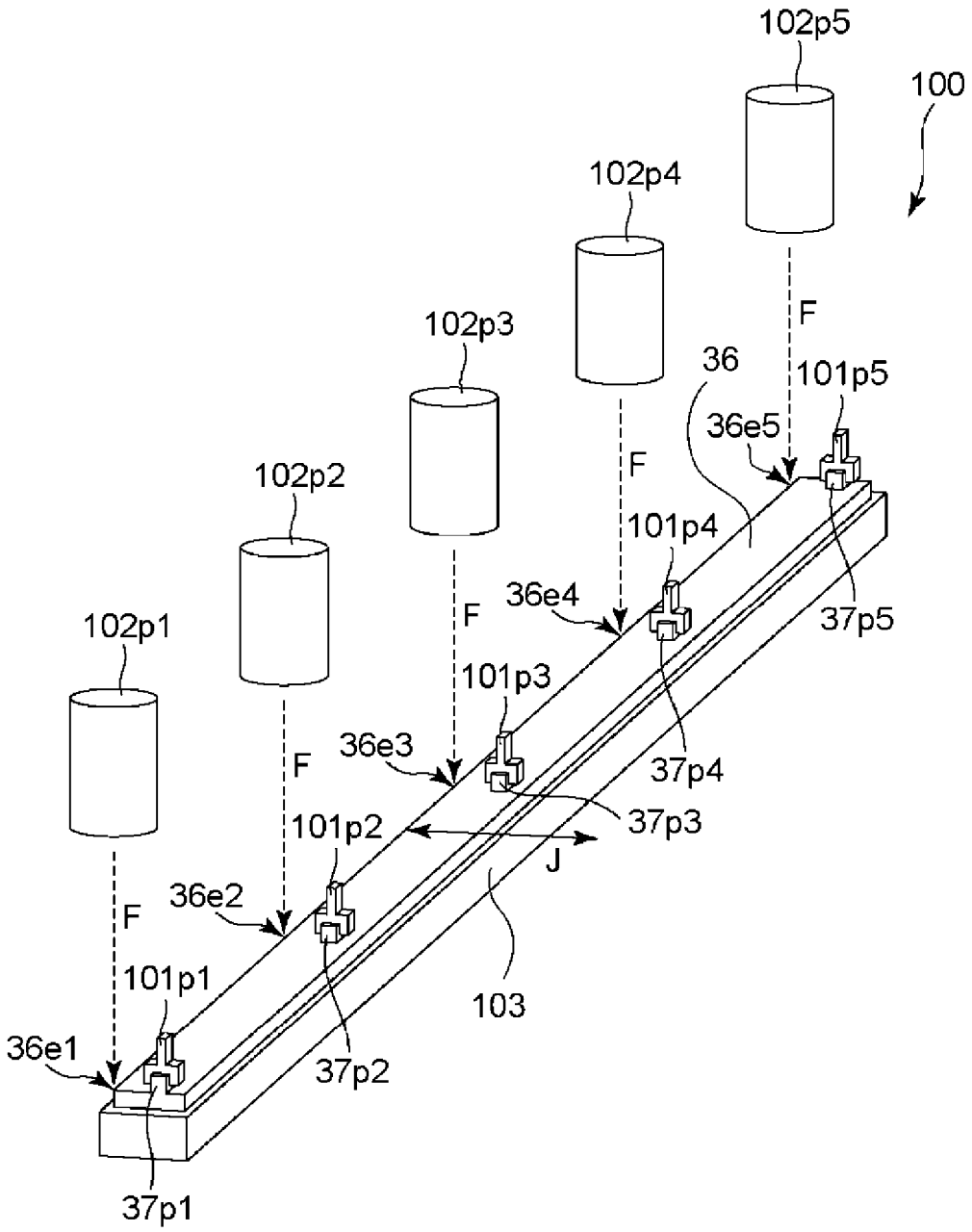
FIGS. 11 to 14 are schematic views for illustrating steps of a method of fixing the resin-made doctor blade.

Then, the device 100 moves the respective fingers 101 in the arrow J direction of FIG. 11 in the state that the grip portions 37 (37p1 to 37p5) of the doctor blade 36 are gripped with the fingers 101 (101p1 to 101p5). As a result, the device 100 applies, to the doctor blade 36, a force for flexing at least a part of a region of the doctor blade 36 corresponding to the maximum image region. Therefore, the grip portions 37 of the doctor blade 36 perform a function as a force receiving portion for receiving a force applied from the device 100 to the doctor blade 36 in order to flex at least the part of the region of the doctor blade 36 corresponding to the maximum image region.

Figure 12:
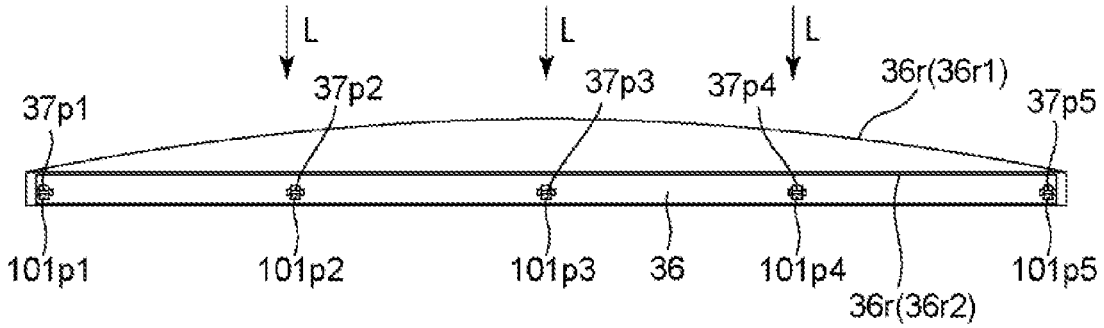

As shown in FIG. 12, as regards the doctor blade 36 (alone), a shape such that with respect to the longitudinal direction of the doctor blade 36, a central portion of the coating amount regulating surface 36r of the doctor blade 36 is largely flexed is formed. For that reason, there is a need to correct the straightness of the coating amount regulating surface 36r of the doctor blade 36 by decreasing a difference in position of the free end portions 36e (36e1 to 36e5) of the doctor blade 36. Therefore, on the basis of a result (a detected outer configuration of the coating amount regulating surface 36r) of measurement of the positions of the free end portions 36e (36e1 to 36e5) of the doctor blade 36, the difference in position of the free end portions 36e (36e1 to 36e5) of the doctor blade 36 is decreased. For that purpose, the device 100 corrects the straightness of the coating amount regulating surface 36r to 50 μm or less by applying, to the doctor blade 36, the force for flexing the region of the doctor blade 36 corresponding to the maximum image region (hereinafter, this force is also referred to as a straightness correcting force).

Then, the device 100 grips the grip portions 37 (37*p*1 to 37*p*5) of the doctor blade 36 mounted on the mounting table 103 with the fingers 101 (101*p*1 to 101*p*5). Then, the device 100 moves the fingers 101 (101*p*1 to 101*p*5) independently forward or backward in the arrow J direction of FIG. 11 in the state that the grip portions 37 (37*p*1 to 37*p*5) of the doctor blade 36 are gripped with the fingers 101 (101*p*1 to 101*p*5), respectively. At this time, the device 100 applied, to the doctor blade 36, the force for flexing at least the region of the doctor blade 36 corresponding to the maximum image region through the grip portions 37 of the doctor blade 36.

In an example of FIG. 12, the device 100 applies the straightness correcting force to the doctor blade 36 so that the outer configuration of the free end portions 36*e*2, 36*e*3 and 36*e*4 are aligned with a reference outer configuration of the free end portions 36*e*1 to 36*e*5 of the doctor blade 36. In the example of FIG. 12, the doctor blade 36 receives, from an outside through the three grip portions 37 (37*p*2 to 37*p*4) of the five grip portions 37 (37*p*1 to 37*p*5), the force for flexing at least the region of the doctor blade 36 corresponding to the maximum image region. Then, by the force received by the doctor blade 36 through the three grip portions 37 (37*p*2 to 37*p*4), the straightness correcting force for correcting the straightness of the coating amount regulating surface 36*r* is applied to the free end portions 36*e*2 to 36*e*4 of the doctor blade 36 in the arrow L direction of FIG. 12. At this time, the straightness correcting force is applied to the coating amount regulating surface 36*r* and thus at least the part of the doctor blade 36 corresponding to the maximum image region is flexed, so that correction of the straightness of the coating amount regulating surface 36*r* of the doctor blade 36 is carried out. In the example of FIG. 12, the shape of the coating amount regulating surface 36*r* of the doctor blade 36 is corrected from a coating amount regulating surface 36*r*1 to a coating amount regulating surface 36*r*2.

As a result, the straightness of the coating amount regulating surface 36*r* of the doctor blade 36 can be corrected to 50 μm or less. Incidentally, in the example of FIG. 12, the reference outer configuration when the outer configuration of the free end portions 36*e* of the doctor blade 36 is aligned with the reference outer configuration is the outer configuration of the free end portions 36*e*1 and 36*e*5 of the doctor blade 36, but a modified example in which the reference outer configuration is the outer configuration of the free end portion 36*e*3 (i.e., the central portion of the coating amount regulating surface 36*r*) may also be employed. In this modified example, the device 100 uses the outer configuration of the free end portion 36*e*3 of the doctor blade 36 as the reference outer configuration and applies, to the doctor blade 36, the straightness correcting force so that the outer configuration of the free end portions 36*e*1, 36*e*2, 36*e*4 and 36*e*5 is aligned with the reference outer configuration.

In this embodiment, in view of a practical mass-production step, a value of correction of the straightness of the coating amount regulating surface 36*r* of the doctor blade 36 is set at about 20 μm-50 μm, and a magnitude of the straightness correcting force applied to the free end portions 36*e* of the doctor blade 36 is set at about 500 g. In general, when the magnitude of the straightness correcting force applied to the free end portions 36*e* of the doctor blade 36 is small, the device 100 can be downsized in expensively. However, in the case where the magnitude of the straightness correcting force applied to the free end portions 36*e* of the doctor blade 36 is excessively small relative to a magnitude of rigidity of the doctor blade 36, the straightness of the coating amount regulating surface 36*r* of the doctor blade 36 cannot be corrected. Therefore, the magnitude of the straightness correcting force applied to the free end portions 36*e* of the doctor blade 36 is set on the basis of the magnitude of the rigidity of the doctor blade 36.

Incidentally, in an example of FIG. 11, the example in which the grip portions 37 are provided at five positions of the doctor blade 36 was described, but when the straightness correcting force can be applied to the coating amount regulating surface 36*r*, positions and the number of the grip portions 37 provided on the doctor blade 36 are not limited to those described above. Further, in the example of FIG. 11, the example in which the grip portions 37 of the doctor blade 36 have a projected shape was described, but the shape of the grip portions 37 is not limited thereto. As described above, the fingers 101 grip the grip portions 37 of the doctor blade 36 in order that the device 100 applies, to the doctor blade 36, the force (straightness correcting force) for flexing at least the part of the region of the doctor blade 36 corresponding to the maximum image regions. Therefore, when the fingers 101 can grip the grip portions 37, the shape of the grip portions 37 may also be, in addition to the projected shape, for example, a recessed shape, a groove shape or a flat shape, and may also be shapes of combinations of these shapes. Incidentally, of the figures in which the doctor blade 36 is shown, the grip portions 37 of the doctor blade 36 are omitted from illustration except for FIGS. 11 to 14.

(2) Positioning Step

Figure 13:
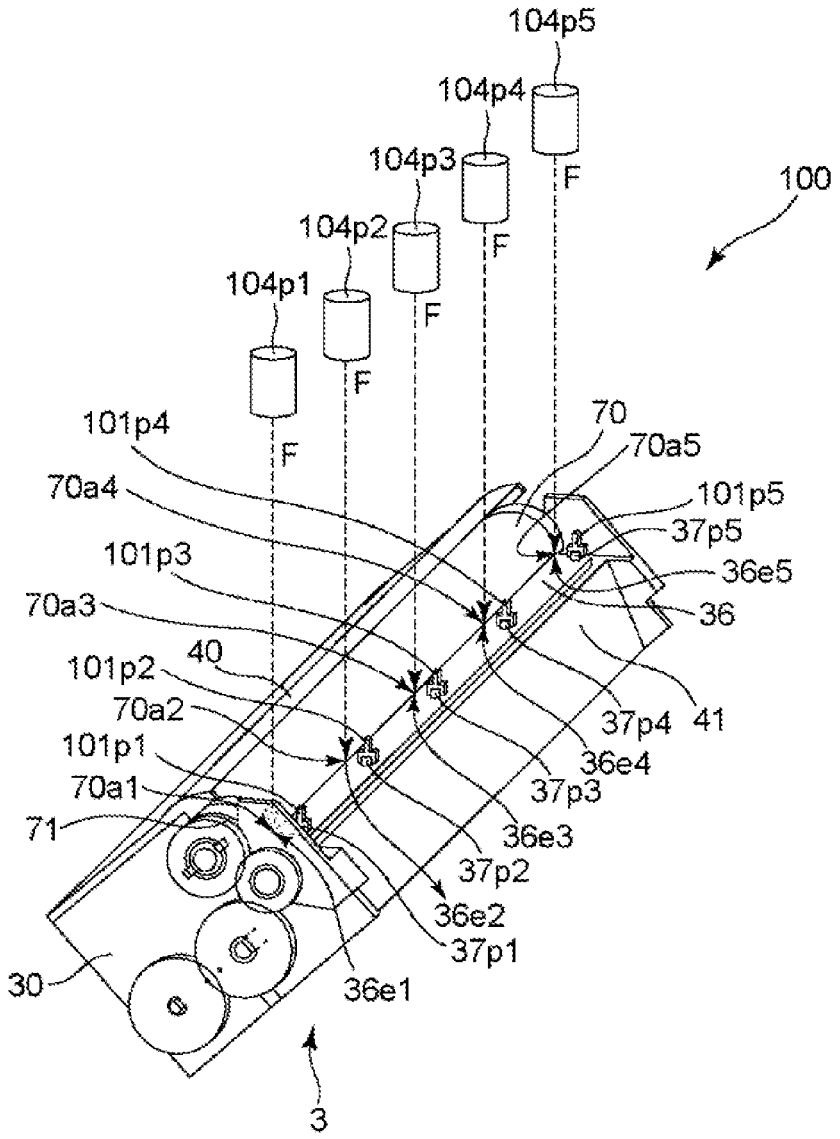
Figure 14:
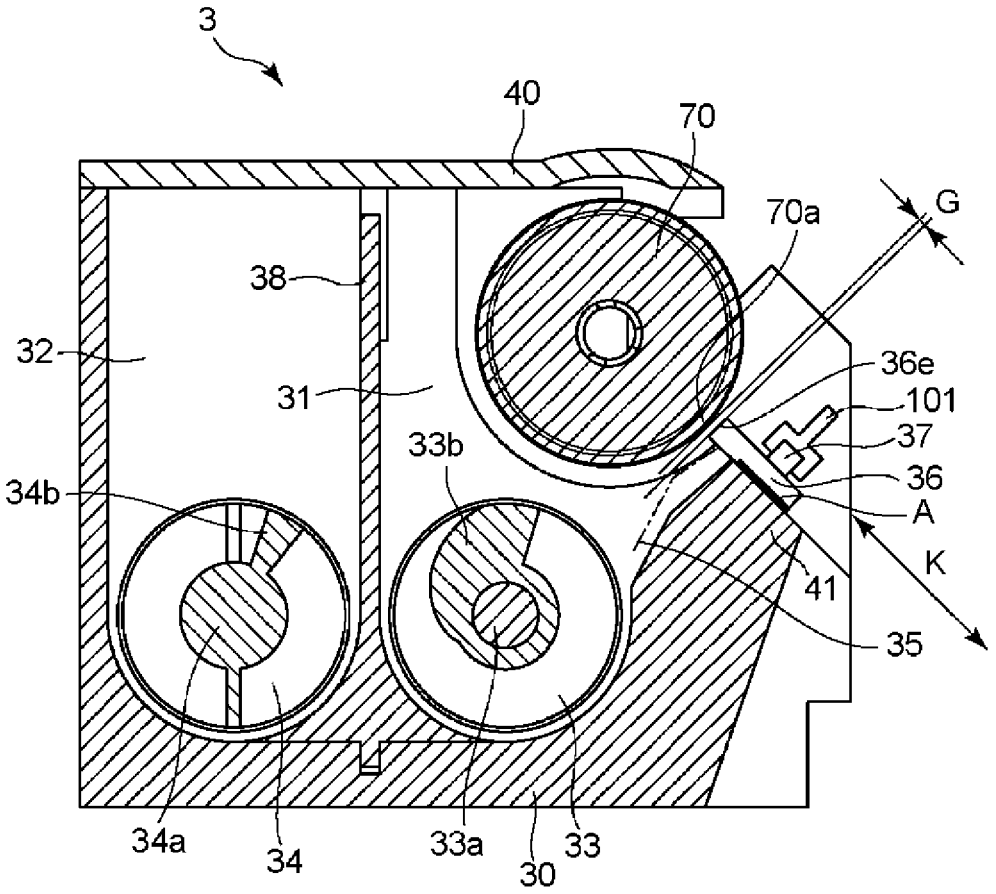

Then, details of the positioning step will be described using schematic views of FIGS. 13 and 14. As shown in FIGS. 13 and 14, the positioning step is carried out in a state that the developing sleeve 70 is supported by the sleeve supporting portion 42 of the developing device frame 30.

The fingers 101 (101*p*1 to 101*p*5) move the doctor blade 36 from the mounting table 103 to the blade mounting portion 41 while holding the doctor blade 36 in a state that the doctor blade 36 is flexed in the flexing step (i.e., in a state that the straightness of the coating amount regulating surface 36*r* is corrected). Incidentally, a movement amount and a movement direction of the fingers 101 (101*p*1 to 101*p*5) are set in advance by a program. The fingers 101 (101*p*1 to 101*p*5) are driven by an actuator and is operated in accordance with the program set in advance.

Then, the device 100 moves, to the blade mounting portion 41 of the developing device frame 30, the doctor blade 36 in a flexed state while the fingers 101 (101*p*1 to 101*p*5) grip the grip portions 37 of the doctor blade 36 in the state that the doctor blade 36 is flexed in the flexing step. Then, the device 100 mounts the flexed doctor blade 36 on the blade mounting portion 41. At this time, the flexed doctor blade 36 is in a state that the doctor blade 36 is mounted (landed) on the blade mounting surface 41*s* of the developing device frame 30 (hereinafter, this state is also referred to as a corrected (abutted) state).

FIG. 13 shows a state that the doctor blade 36 is mounted on the blade mounting surface 41*s* while the grip portions 37 (37*p*1 to 37*p*5) of the doctor blade 36 flexed in the flexing step is in a gripped state with the fingers 101 (101*p*1 to 101*p*5).

As described above, in order to suppress non-uniformity of the amount of the developer carried on the surface of the developing sleeve 70 with respect to the longitudinal direction of the developing sleeve 70, a range of a tolerance of the SB gap G (i.e., a range in which the value of the SB gap G is allowed as a tolerance thereof relative to a target value of the SB gap G) is set at a range of about 60 μm. Thus, the range of the tolerance of the SB gap G is severe, and therefore, there is a low possibility that the SB gap G falls within an adjusting range of the SB gap G in consideration of the range of the tolerance of the SB gap G (i.e., the adjusting range of the SB gap G includes the target value of the SB gap G) when the doctor blade 36 is only mounted simply on the blade mounting surface 41*s* (FIGS. 4 and 5) of the developing device frame 30. Therefore, there is a need to adjust the SG gap G so as to fall within the adjusting range of the SB gap G by determining a fixing position of the doctor blade 36 to the blade mounting surface 41*s* of the developing device frame 30 so that the SB gap G falls within the tolerance thereof.

The device 100 includes, at five positions, the cameras 104 (104*p*1 to 104*p*5) for measuring associated five positions of the free end portions 36*e* (36*e*1 to 36*e*5) of the doctor blade 36 in a state that the doctor blade 36 is mounted on the blade mounting surface 41*s* of the developing device frame 30 by the fingers 101. The cameras 104 (104*p*1 to 104*p*5) are disposed along a direction (arrow F direction of FIG. 13) toward the free end portions 36*e* (36*e*1 to 36*e*5) of the doctor blade 36, so that the cameras 104 (104*p*1 to 104*p*5) can measure the positions of the free end portions 36*e* (36*e*1 to 36*e*5) of the doctor blade 36. Incidentally, in this embodiment, an example in which measurement of the positions of the free end portions 36*e* (36*e*1 to 36*e*5) of the doctor blade 36 is carried out using the cameras 104 (105*p*1 to 104*p*5) will be described, but a modified example in which the measurement is carried out using non-correct sensors may also be employed.

Here, a measuring method (calculating method) of the magnitude of the SB gap G will be described. The measurement of the SB gap G is carried out in a state that the developing sleeve 70 is supported by the sleeve supporting portion 42 of the developing device frame 30 and the doctor blade 36 is mounted on the blade mounting portion 41 of the developing device frame 30 and that the cover frame 40 is fixed to the developing device frame 30. Further, when the magnitude of the SB gap G is measured, a light source (for example, an LED array, a light guide and the like) is inserted into the developing chamber 31 over the longitudinal direction of the developing chamber 31. The light source inserted in the developing chamber 31 emit light from an inside of the developing chamber 31 toward the SB gap G. Then, the cameras 104 (104*p*1 to 104*p*5) pick up light beams emitted to an outside of the developing device frame 30 through the SB gap G. At this time, the cameras 104 (104*p*1 to 104*p*5) read positions 70*a* (70*a*1 to 70*a*5) where the developing sleeve 70 is closest to the doctor blade 36 on the surface of the developing sleeve 70 and read the free end portions 36*e* (36*e*1 to 36*e*5) of the doctor blade 36. Then, the device 100 converts pixel values into distances from image data generated by reading the free end portions 36*e* (36*e*1 to 36*e*5) through the cameras 104 (104*p*1 to 104*p*5), so that the device 100 calculates the magnitude of the SB gap G. In the case where the calculated SB gap G does not fall within a predetermined range, the device 100 carries out adjustment of the SB gap G.

Here, details of an adjusting method of the SB gap G will be described using a schematic view of FIG. 14. The device 100 moves the fingers 101 (101*p*1 to 101*p*5) in an arrow K direction shown in FIG. 14 in the state that the grip portions 37 (37*p*1 to 37*p*5) of the doctor blade 36 are gripped by the fingers 101 (101*p*1 to 101*p*5). Incidentally, the arrow F direction of FIG. 14 is a direction in which a position of the doctor blade 36 relative to the developing sleeve 70 supported by the sleeve supporting portion 42 of the developing device frame 30 is adjusted (i.e., a direction in which the SB gap G is defined). Further, the arrow K direction of FIG. 14 shows a direction in which the doctor blade 36 moves toward and away from the developing sleeve 70 supported by the sleeve supporting portion 42 of the developing device frame 30. As a result, the positions of the free end portions 36*e* (36*e*1 to 36*e*5) of the doctor blade 36 relative to the positions 70*a* (70*a*1 to 70*a*5) where the developing sleeve 70 is closest to the doctor blade 36 on the surface of the developing sleeve 70 are adjusted.

For example, it is assumed that the SB gap G calculated at an initial position where the doctor blade 36 is mounted on the blade mounting surface 41*s* of the developing device frame 30 is 350 μm. On the other hand, it is assumed that the adjusting range of the SB gap G is 300 μm±30 μm and that the tolerance of the SB gap G is allowed up to 60 μm to the maximum. In this case, at the initial position where the doctor blade 36 is mounted on the blade mounting surface 41*s* of the developing device frame 30, the calculated SB gap G is 50 μm larger than 300 μm which is a nominal value of the SB gap G. Therefore, the fingers 101 translate the doctor blade 36 in the direction which is the arrow K direction of FIG. 14 and in which the doctor blade 36 is caused to approach the surface of the developing sleeve 70 by 50 μm.

Then, the cameras 104 (104*p*1 to 104*p*5) read the positions 70*a* (70*a*1 to 70*a*5) where the developing sleeve 70 is closest to the doctor blade 36 translated by the fingers 101 are read the free end portions 36*e* (36*e*1 to 36*e*5) of the doctor blade 36 translated by the fingers 101. Then, the device 100 calculates the SB gap G again as to the doctor blade 36 translated by the fingers 101.

In the case where the device 100 discriminated that the magnitude of the calculated SB gap G falls within the range (300 μm±30 μm) of the adjusting value of the SB gap G, the device 100 ends the adjustment of the SB gap described above. On the other hand, in the case where the device 100 discriminated that the magnitude of the calculated SB gap G falls within the adjusting range (300 μm±30 μm) of the SB gap G, the device 100 repeats the adjustment of the SB gap G until the magnitude of the calculated SB gap G falls within the adjusting range (300 μm±30 μm) of the SB gap G. Thus, the doctor blade 36 is fixed to the blade mounting portion 41 of the developing device frame 30 in a state that the straightness of the coating amount regulating surface 36*r* is corrected to 50 μm or less, whereby the magnitude of the SB gap G can be caused to fall within the adjusting range of the SB gap G.

In order to perform the adjustment of the SB gap G with high accuracy, there is a need to consider not only the straightness of the coating amount regulating surface 36*r* of the doctor blade 36 but also the straightness of the surface of the developing sleeve 70. A sleeve pipe constituting an outer shell is made of metal, and therefore, the straightness of the surface of the developing sleeve 70 can be made ±15 μm or less which is high accuracy by subjecting the sleeve pipe to secondary cutting. However, the straightness of ±15 μm of the developing sleeve 70 can be regarded that in the case where the developing sleeve 70 in practical use is in a rotation state, an outer diameter of the developing sleeve 70 fluctuates in a range of ±15 μm. Therefore, in the positioning step, the fingers 101 performs the following operation in a state that the doctor blade 36 is mounted on the blade mounting surface 41*s* while translating the doctor blade 36 in a direction in which the doctor blade 36 is caused to approach the surface of the developing sleeve 70.

Before the doctor blade 36 is mounted on the blade mounting surface 41*s* the device 100 applies the straightness correcting force for correcting the straightness of the coating amount regulating surface 36*r* to the doctor blade 36 through the grip portions 37 of the doctor blade 36. That is, before the doctor blade 36 is mounted on the blade mounting surface 41*s*, the device 100 corrects the straightness of the coating amount regulating surface 36*r* to 50 μm or less in advance. Then, the device 100 mounts the doctor blade 36 in the state that the straightness of the coating amount regulating surface 36*r* has been corrected to 50 μm or less, on the blade mounting surface 41*s*.

Then, in a state that the doctor blade 36 is fixed to the blade mounting portion 41, the device 100 applies an adjusting force for adjusting a position of the coating amount regulating surface 36*r* of the doctor blade 36 relative to the developing sleeve 70, to the doctor blade 36 through the grip portions 37 of the doctor blade in order to cause the SB gap G to fall within a predetermined range (i.e., within the adjusting range of the SB gap G). That is, the fingers 101 flex at least a part of a region of the doctor blade 36 corresponding to the maximum image region so that the SG gap G measured by the cameras 104 falls within the adjusting range of the SB gap G in the state that the doctor blade 36 is mounted on the blade mounting surface 41*s*. At this time, at least the part of the region of the doctor blade 36 corresponding to the maximum image region is in a flexed state in a direction in which the doctor blade 36 mounted on the blade mounting portion 41 moves toward or away from the developing sleeve 70 supported by the sleeve supporting portion 42.

As a result, the adjustment of the SB gap G can be carried out with high accuracy in consideration of not only the straightness of the coating amount regulating surface 36*r* of the doctor blade 36 but also the straightness of the surface of the developing sleeve 70. Further, the position of the coating amount regulating surface 36*r* of the doctor blade 36 relative to the developing sleeve 70 can be adjusted so that the tolerance of the SB gap G is 60 μm or less over the longitudinal direction of the developing sleeve 70. In that case, after the position of the coating amount regulating surface 36*r* of the doctor blade 36 relative to the developing sleeve 70 is adjusted so that the tolerance of the SB gap G is 60 μm or less over the longitudinal direction of the developing sleeve 70, the doctor blade 36 is fixed to the blade mounting portion 41 in the fixing step described later.

Incidentally, in the case where the straightness of the surface of the developing sleeve 70 is further high accuracy (for example, ±5 μm or less), when the SB gap G is adjusted, the SB gap G may only be required to be adjusted in consideration of the straightness of the coating amount regulating surface 36*r*, and it is not essential that the SB gap G is adjusted also in consideration of the straightness of the surface of the developing sleeve 70. Similarly, in the case where a latitude of the SB gap G is large, when the SB gap G is adjusted, although the SB gap G is adjusted in consideration of the straightness of the coating amount regulating surface 36*r* of the doctor blade 36, and it is not essential that the SB gap G is adjusted also in consideration of the straightness of the surface of the developing sleeve 70.

(3) Fixing Step

Then, details of the fixing step will be described using the schematic view of FIG. 14. In this embodiment, as shown in FIG. 14, the fixing step is performed in a state that the doctor blade 36 in the flexed state in the flexing step is mounted, at a predetermined position of the blade mounting portion 41 of the developing device frame 30 determined in the positioning step.

In the case where the doctor blade 36 is fixed to the blade mounting portion 41 with the adhesive A, in order to adhesively bond the doctor blade 36 to the blade mounting portion 41 with sufficiently adhesive strength, a degree of adhesiveness (contactness) between the doctor blade 36 and the blade mounting portion 41 is important. This is because in the case where the gap between the doctor blade 36 and the blade mounting portion 41 is large when the doctor blade 36 is fixed to the blade mounting portion 41 with the adhesive A, the adhesive strength is weakened even when the adhesive A is interposed in the gap.

In order to form a state that desired adhesive strength is ensured between the blade mounting portion 41 and the doctor blade 36 mounted in a predetermined position of the blade mounting portion 41, in a period until the adhesive A is caused, there is a need to bring the doctor blade 36 into intimate contact with the blade mounting portion 41. Therefore, in a state that the doctor blade 36 is mounted on the blade mounting surface 41*s* of the developing device frame 30, the device 100 applies a load for bringing the doctor blade 36 into intimate contact with the blade mounting portion 41 by placing a weight having a predetermined weight on the doctor blade 36. In order to obtain sufficient adhesive strength, the fingers 101 are required to continuously hold the doctor blade 36 in a state that the doctor blade 36 is brought into intimate contact with the blade mounting portion 41 by continuously applying such a load for a time until the adhesive A is sufficiently cured. For example, in the case where a curing time of the adhesive A is 15 seconds, the curing time may only be required to be set so that the load for bringing the doctor blade 36 into intimate contact with the blade mounting portion 41 is applied to the doctor blade 36 for 20 seconds with a tolerance.

Then, after adhesive bonding of the doctor blade 36 to the blade mounting portion 41 is completed, the device 100 raises the weight and thus eliminates the load from the doctor blade 36. Then, the device 100 operates the fingers 101 (101*p*1 to 101*p*5) and separates the fingers 101 (101*p*1 to 101*p*5) from the doctor blade 36, and thereafter, the device 100 moves the fingers 101 (101*p*1 to 101*p*5) to a preparatory position for a subsequent operation.

Incidentally, in this embodiment, the device 100 applies the adhesive A onto the blade mounting portion 41 over a substantially entire region corresponding to the maximum image region before the doctor blade 36 is mounted on the blade mounting surface 41*s* of the developing device frame 30. Then, the doctor blade 36 in the state that the doctor blade 36 is flexed in the flexing step is adhesively bonded (fixed) to the blade mounting portion 41 over the substantially entire region corresponding to the maximum image region. At this time, the doctor blade 36 is adhesively bonded (fixed) to the blade mounting portion 41 in a state that the straightness of the coating amount regulating surface 36*r* is corrected to 50 μm or less. Thus, in this embodiment, of a region of the doctor blade 36 corresponding to the maximum image region, as regards a region in which the doctor blade 36 is flexed for correcting the straightness of the coating amount regulating surface 36*r*, the doctor blade 36 is fixed to the blade mounting portion 41. As a result, it is possible to suppress that of the region of the doctor blade 36 corresponding to the maximum image region, the region in which the doctor blade 36 is flexed for correcting the straightness of the coating amount regulating surface 36*r* is returned from the flexed state toward an original state before the doctor blade 36 is flexed.

In an example of FIGS. 11 to 14 described above, an example in which the device 100 applies the adhesive A onto the blade mounting surface 41*s* over the substantially entire region corresponding to the maximum image region before the doctor blade 36 is mounted on the blade mounting surface 41*s* of the developing device frame 30 was described. On the other hand, depending on the shape of the doctor blade 36, it would be also considered that a region in which it is difficult to apply the adhesive A onto the blade mounting surface 41*s* by the device 100 exists. In such a case, when the doctor blade 36 is fixed to the blade mounting portion 41 with the adhesive A in a region in which the doctor blade 36 receives a force for flexing at least a part of the region of the doctor blade 36 corresponding to the maximum image region, the adhesive A may also be not applied onto a part of the blade mounting surface 41*s*.

Therefore, application of the adhesive A onto the blade mounting surface 41*s* over the substantially entire region corresponding to the maximum image region means that the following condition is satisfied. The condition is such that the adhesive A is applied onto the blade mounting surface 41*s* in a region, of the region of the doctor blade 36 corresponding to the maximum image region, which includes the region in which the doctor blade 36 is flexed for correcting the straightness of the coating amount regulating surface 36*r* and which is 95% or more of the region corresponding to the maximum image region with respect to the longitudinal direction of the blade mounting surface 41*s*.

Incidentally, in the example of FIGS. 11 to 14, an example of application of the adhesive A on the blade mounting portion 41 side was described, but a modified example in which the adhesive A is applied on the doctor blade 36 side or a modified example in which the adhesive A is applied on both of the blade mounting portion 41 side and the doctor blade 36 side may also be employed. Further, as timing when the adhesive A is applied on the blade mounting portion 41 side, when the application of the adhesive A is carried out in advance of a start of the positioning step (preferably, in parallel to the flexing step), a total time required for performing a series of steps of the method of fixing the doctor blade 36 can be shortened. That is, in this example, the series of steps mean a series of steps such that the adhesive A is applied onto the blade mounting portion 41 of the developing device frame 30 while correcting the straightness of the coating amount regulating surface 36*r*. Therefore, in the example of FIGS. 11 to 14, a step of applying the adhesive A onto the blade mounting portion 41 side of the developing device frame 30 is performed in advance of the start of the positioning step.

In the case where the doctor blade 36 is fixed with the adhesive A, in the positioning step, when the adhesive A is cured along the adjustment of the SB gap G with respect to the doctor blade 36 mounted on the blade mounting surface 41*s*, subsequently, the adjustment of the SB gap G cannot be performed. For that reason, there is a need that the adjustment of the SB gap G is required to be completed until the adhesive A is cured. The curing time of the adhesive A is determined depending on a material of the adhesive A or an application amount of the adhesive A. For that reason, the curing time of the adhesive A can be estimated to some extent. Therefore, the number of times that the adjustment of the SB gap G can be repetitively performed is determined in advance from a time required for performing the adjustment of the SB gap G once. For that reason, within the determined number of times of repetition of the SB gap G, the adhesive A has not been cured yet, and therefore, the adjustment of the SB gap G can be repetitively carried out.

Incidentally, the repetitive adjustment of the SB gap G has precedence over the shortening of the total time required for performing the series of steps of the method of fixing the doctor blade 36, a modified example in which the adhesive A is applied onto the blade mounting portion 41 side after the positioning step is completed may also be employed. In the modified example, information on the position, where the doctor blade 36 is fixed to the blade mounting portion 41 of the developing device frame 30, determined from the adjustment of the SB gap G in the positioning step is stored in a memory provided in the device 100. Then, after the positioning step is completed, the device 100 performs an applying step of applying the adhesive A onto the blade mounting portion 41 side of the developing device frame 30. Then, after the adhesive A is applied on the blade mounting portion 41 side, on the basis of the information of the fixing position of the doctor blade 36 stored in the memory, the device 100 mounts the doctor blade 36 in the flexed state in the flexing step, on the blade mounting surface 41*s* of the developing device frame 30. Then, after the doctor blade 36 in the flexed state is mounted on the blade mounting surface 41*s*, the device 100 may only be required to start the fixing step described above.

(Structure of Developing Device According to First Embodiment)

As described above, in the developing device including the regulating blade made of the resin material and the developing device frame made of the resin material, a constitution in which the regulating blade made of the resin material is mounted and fixed with the adhesive to the blade mounting portion of the developing device frame made of the resin material would be considered. In the case where the regulating blade is fixed to the blade mounting portion with the adhesive, in order to adhesively bond the regulating blade to the blade mounting portion with sufficient adhesive strength, in a period until the adhesive is cured, there is a need to bring the regulating blade into intimate contact with the blade mounting portion. Therefore, in order to bring the regulating blade into intimate contact with the blade mounting portion in the period until the adhesive is cured, the load is continuously applied to the regulating blade in the state that the regulating blade is mounted on the blade mounting portion. Then, after the adhesive is cured and thus the regulating blade is adhesively bonded to the blade mounting portion, the load applied to the regulating blade is eliminated.

During continuous application of the load to the regulating blade in the state that the regulating blade is mounted on the blade mounting portion, the load is also applied to the blade mounting portion of the developing device frame, and therefore, the developing device frame is deformed by this load in some instances. At this time, with an increasing degree of deformation of the developing device frame, when the load applied to the regulating blade is eliminated, there is a tendency that a magnitude of residual stress generating in the developing device frame increases. In the case where the developing device frame is deformed by this residual stress after the regulating blade is adhesively bonded to the blade mounting portion, there is a liability that a position of the free end portion of the regulating blade fluctuates with the deformation of the developing device frame. In such a case, although the regulating blade is adhesively bonded to the blade mounting portion after the SB gap is applied so that the magnitude of the SB gap falls within the predetermined range, the magnitude of the SB gap fluctuates after the regulating blade is mounted on the blade mounting portion. However, the regulating blade has already been adhesively bonded to the blade mounting portion, and therefore, it is difficult to adjust the SB gap again so that the magnitude of the SB gap falls within the predetermined range.

Therefore, it is desired that adhesive bonding of the regulating blade to the blade mounting portion with sufficient adhesive strength and suppression of the degree of deformation of the developing device frame are compatibly realized by applying the load to the regulating blade in the state that the regulating blade is mounted on the blade mounting portion. In this embodiment, a fluctuation in magnitude of the SB gap with deformation of the developing device frame is suppressed by applying the load to the regulating blade when the regulating blade made of the resin material is fixed with the adhesive to the developing device frame made of the resin material. In the following, details will be described.

A constitution of the developing device according to this embodiment will be described using a sectional view of FIG. 15 and a sectional view (enlarged view) of FIG. 16.

Figure 15:
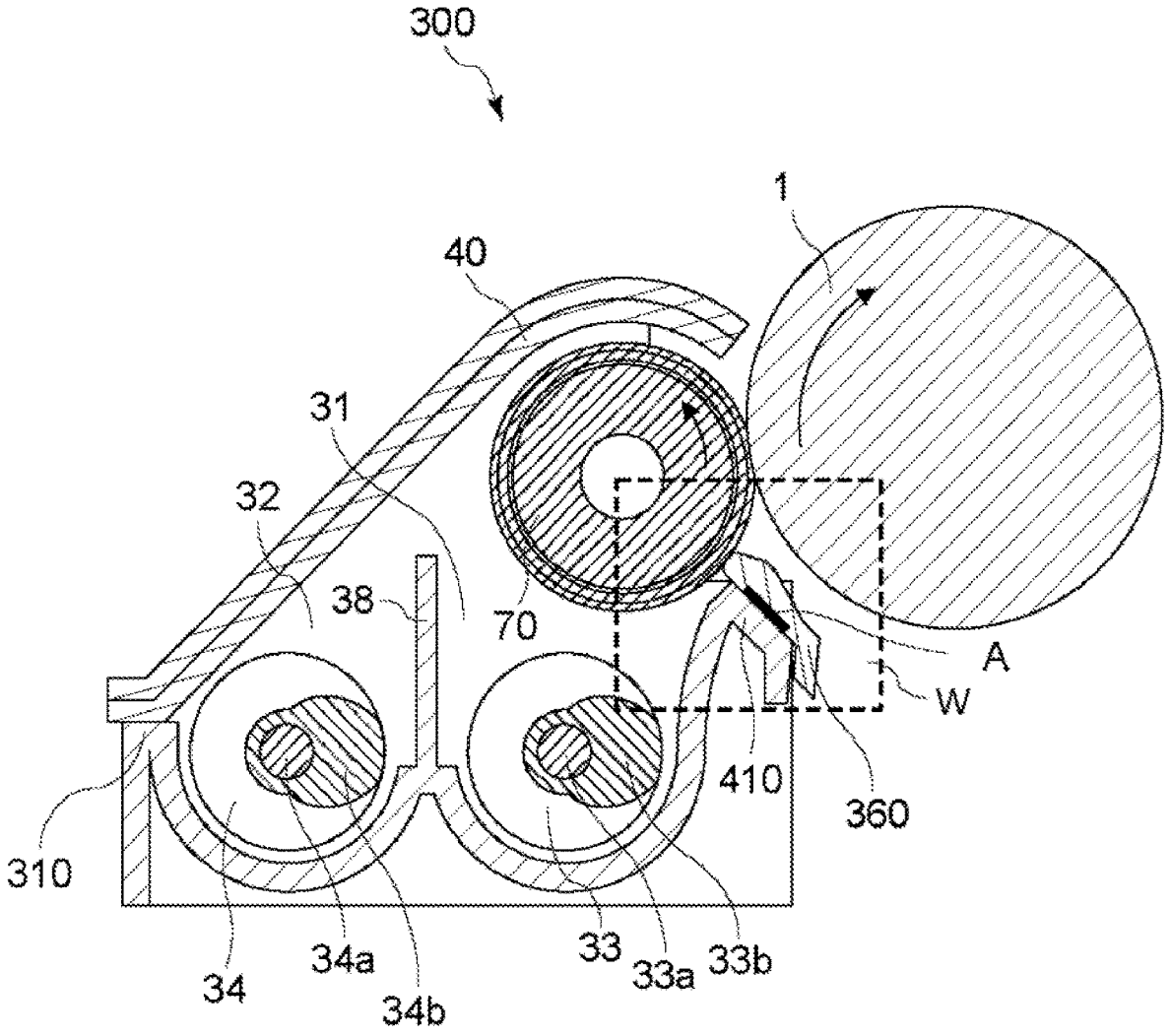
FIG. 15 is a sectional view showing a structure of a developing device according to First Embodiment.
Figure 16:
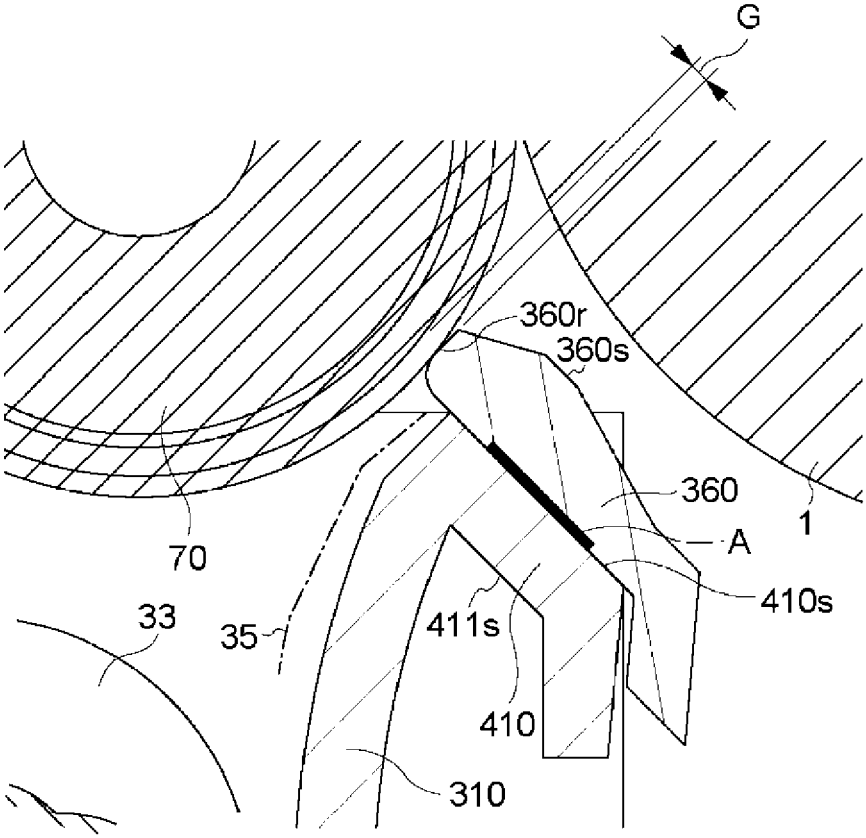
FIG. 16 is a sectional view (enlarged view) showing the structure of the developing device according to First Embodiment.

FIG. 15 is the sectional view of a developing device 300 in a cross section perpendicular to the rotational axis of the developing sleeve 70. FIG. 16 is the sectional view of the developing device 300 in the cross section perpendicular to the rotational axis of the developing sleeve 70, and is the enlarged view of the developing device 300 in the neighborhood (region W of FIG. 15) of a blade mounting portion 410 (particularly a blade mounting surface 410*s*) of a developing device frame 310. In FIGS. 15 and 16, constituent elements to which the same reference numerals or symbols as those in FIG. 4 are added are the same as those in FIG. 4. In the constitution of the developing device 300 according to this embodiment, a difference from the constitution of the developing device 3 described above with reference to FIG. 4 will be principally described. The developing device 300, a doctor blade 360, the developing device frame 310, the blade mounting portion 410, and the blade mounting surface 410*s* which are shown in FIG. 15 and subsequent figures correspond to the developing device 3, the doctor blade 36, the developing device frame 30, the blade mounting portion 41, and the blade mounting surface 41*s*, respectively, which are described above with reference to FIG. 4.

In a constitution of the developing device 300 according to this embodiment, similarly as in the constitution of the developing device 3 described above with reference to FIG. 4, the doctor blade 360 is fixed to the blade mounting portion 410 with the adhesive A. Incidentally, similarly as in the example of FIGS. 11 to 14, as regards the adhesive A, an example in which the adhesive A is applied on the blade mounting portion 410 side will be described below, but a modified example in which the adhesive A is applied on the doctor blade 360 side or a modified example in which the adhesive A is applied on both of the blade mounting portion 410 side and the doctor blade 360 side may also be employed.

On the other hand, in the constitution of the developing device 300 in this embodiment, the shape of the doctor blade 360 and the shape of the developing device frame 310 (particularly, the blade mounting portion 410) are different from those in the constitution of the developing device 3 described above with reference to FIG. 4.

The doctor blade 360 has a surface to which a force for pressing, against the blade mounting portion 410, the doctor blade 360 mounted on the blade mounting portion 410 on which the adhesive A is applied (hereinafter, this force is referred to as a pressing force (pressure) $f_1$) is applied (hereinafter, this surface is referred to as a force applying surface 360*s*). Incidentally, the force applying surface 360*s* of the doctor blade 360 is the surface opposite from a surface of the doctor blade 360 where the doctor blade 360 is mounted on the blade mounting surface 410*s*. To the force applying surface 360*s* of the doctor blade 360, a load for bringing the doctor blade 360 into intimate contact with the blade mounting portion 410 on which the adhesive A is applied is to be applied.

The blade mounting portion 410 has a surface to which a force for supporting (backing up) the blade mounting portion 410 on which the adhesive A is applied (hereinafter, this force is referred to as a supporting force $f_2$) is applied (hereinafter, this surface is referred to as a force applying surface 411*s*). Incidentally, the force applying surface 411*s* of the blade mounting portion 410 is provided on a side opposite from the blade mounting surface 410*s* of the blade mounting portion 410. To the force applying surface 411*s* of the blade mounting portion 410, a force for backing up the blade mounting portion 410 so as to suppress deformation of the developing device frame 310 by the load applied to the doctor blade 360 when the doctor blade 360 is fixed to the blade mounting portion 410 with the adhesive A is to be applied. That is, at least a part of the pressing force $f_1$ applied to not only the force applying surface 360*s* of the doctor blade 360 but also the blade mounting portion 410 is canceled by the supporting force $f_2$ applied to the force applying surface 411*s* of the blade mounting portion 410.

Then, deformation of the developing device frame 310 by the load applied to the doctor blade 360 when the doctor blade 360 is fixed to the developing device frame 310 with the adhesive A will be described using sectional views of parts (a) and (b) of FIG. 17. Parts (a) and (b) of FIG. 17 are the sectional views of the developing device 300 in a cross section perpendicular to a rotational axis of the developing sleeve 70 and are enlarged views of the developing device 300 in the neighborhood of the blade mounting portion 410 (especially, the blade mounting surface 410*s*) of the developing device frame 310.

In order to form a state that desired adhesive strength is ensured between the blade mounting portion 410 and the doctor blade 360 mounted in a predetermined position of the blade mounting portion 410, in a period until the adhesive A is caused, there is a need to bring the doctor blade 360 into intimate contact with the blade mounting portion 410. Therefore, as shown in part (a) of FIG. 17, the pressing force $f_1$ is applied to the force applying surface 360*s* of the doctor blade 360. The pressing force $f_1$ applied to the force applying surface 360*s* of the doctor blade 360 is also applied to the blade mounting portion 410 of the developing device frame 310, so that the developing device frame 310 is deformed by this pressing force $f_1$ as shown in part (b) of FIG. 17.

At this time, with an increasing degree of deformation of the developing device frame 310, when the application of the pressing force $f_1$ to the force applying surface 360*s* of the doctor blade 360 is stopped (eliminated), there is a tendency that a magnitude of the residual stress generated in the developing device frame 310 increases. In the case where the developing device frame 310 is deformed by this residual stress after the doctor blade 360 is adhesively bonded to the blade mounting portion 410, there is a liability that a position of the free end portion (coating amount regulating surface) of the doctor blade 360 fluctuates with the deformation of the developing device frame 310. In such a case, although the doctor blade 360 is adhesively bonded to the blade mounting portion 410 after the SB gap G is applied so that the magnitude of the SB gap G falls within the predetermined range, the magnitude of the SB gap G fluctuates after the regulating blade is mounted on the blade mounting portion 410. As a result, the SB gap G fluctuates with a fluctuation of the position of the free end portion (coating amount regulating surface) of the doctor blade 360 from a position 360*r* shown in part (a) of FIG. 17 to a position 360*r*' shown in part (b) of FIG. 17, so that there is a liability that the magnitude of the SB gap G falls outside the predetermined range. However, the doctor blade 360 has already been adhesively bonded to the blade mounting portion 410, and therefore, it is difficult to adjust the SB gap G again so that the magnitude of the SB gap G falls within the predetermined range.

Therefore, in this embodiment, by applying the load to the doctor blade 360, adhesive bonding of the doctor blade 360 to the blade mounting portion 410 with sufficient adhesive strength and suppression of the degree of deformation of the developing device frame 310 are compatibly realized. Details of a method of fixing the doctor blade according to this embodiment for the purpose of compatibly realizing these two matters will be described with reference to FIG. 18 and subsequent figures.

FIG. 18 is a schematic view of a device 100 for performing steps of the method of fixing the doctor blade 360 to the blade mounting portion 410. In a state that the doctor blade 360 is mounted on the blade mounting surface 410*s*, weights 1010 (1010*a* to 1010*d*) each having a predetermined weight are placed on the force applying surface 360*s* of the doctor blade 360. As a result, the load (pressing force $f_1$) for bringing the doctor blade 360 into intimate contact with the blade mounting portion is applied to the doctor blade 360. As shown in FIG. 18, the device 100 includes cameras 1040 (1040*a* to 1040*c*) at three positions each where the position of the free end portion of the doctor blade 360 can be measured.

The device 100 measures the positions of the free end portions of the doctor blade 360 and then holds the doctor blade 360 at a position such that the magnitude of the SB gap G falls within the predetermined range. Thereafter, in a period until the adhesive A is cured, the load (pressing force $f_1$) is applied to the doctor blade 360 by placing the weights 1010 (1010*a* to 1010*d*) each having the predetermined weight on the force applying surface 360*s* of the doctor blade 360, so that sufficient adhesive strength is obtained.

At this time, the developing device frame 310 is deformed by the load (pressing force $f_1$) applied to the force applying surface 360*s* of the doctor blade 360. For example, in the case where the weight of the weights 1010 (1010*a* to 1010*d*) is set at 1500 g, with deformation of the developing device frame 310, the doctor blade 360 is deformed in a direction in which the magnitude of the SB gap G decreases by 15-20 μm.

Therefore, arms 1020 (1020*a* to 1020*d*) for applying, to the force applying surface 411*s* of the blade mounting portion 410, a force (supporting force $f_2$) resisting against the load (pressing force $f_1$) applied to the force applying surface 360*s* by the weights 1010 (1010*a* to 1010*d*) are provided. Incidentally, in a state before the pressing force $f_1$ is applied to the force applying surface 360*s* of the doctor blade 360, the arms 1020 (1020*a* to 1020*d*) are disposed so as to be spaced from the force applying surface 411*s* of the blade mounting portion 410 by several μm to several tens of μm. That is, in a period until the pressing force $f_1$ is applied to the force applying surface 360*s* of the doctor blade 360, the arms 1020 are spaced from the force applying surface 411*s* and thus do not abut against the force applying surface 411*s* of the blade mounting portion 410, so that excessive internal stress is not generated in the developing device frame 310.

When the developing device frame 310 is deformed by the pressing force $f_1$ which is also applied to the blade mounting portion 410 under application to the force applying surface 360*s* of the doctor blade 360, the force applying surface 411*s* of the deformed blade mounting portion 410 is abutted against (supported by) the arms 1020. As a result, during application of the load (pressing force $f_1$) to the force applying surface 360*s* of the doctor blade 360, the arms 1020 (1020*a* to 1020*d*) apply the supporting force $f_2$ to the force applying surface 411*s* of the blade mounting portion 410 of the deformed developing device frame 310. That is, at least a part of the pressing force $f_1$ applied to also the blade mounting portion 410 under application to the force applying surface 360*s* of the doctor blade 360 is canceled by the supporting force $f_2$ applied to the force applying surface 411*s* of the blade mounting portion 410. Then, after adhesive bonding of the doctor blade 360 to the blade mounting portion 410 is completed, the device 100 raises the weights 1010 (1010*a* to 1010*d*) and thus eliminates the load (pressing force $f_1$) from the doctor blade 360.

As a result, the degree of deformation of the developing device frame 310 is suppressed, and therefore, when the load (pressing force $f_1$) applied to the doctor blade 360 is eliminated, the magnitude of the residual stress generated in the developing device frame 310 can be decreased. Then, after the doctor blade 360 is adhesively bonded to the blade mounting portion 410, the degree of the deformation of the developing device frame 310 due to this residual stress is suppressed, and correspondingly, a degree of a fluctuation in position of the free end portion of the doctor blade 360 is suppressed. Therefore, a degree of a fluctuation in magnitude of the SB gap G after the doctor blade 360 is adhesively bonded to the blade mounting portion 410 can be suppressed, so that there is no liability that the magnitude of the SB gap G falls outside the predetermined range after the doctor blade 360 is adhesively bonded to the blade mounting portion 410.

In an example of FIG. 18, an example in which the four weights 1010 (1010*a* to 1010*d*) were used was described, but when sufficient adhesive strength can be obtained, the number of weights may also be more than four or less than four. Further, the arms 1020 (1020*a* to 1020*d*) for applying the supporting force $f_2$ to the force applying surface 411*s* of the blade mounting portion 410 are disposed so as to correspond to positions where the weights 1010 (1010*a* to 1010*d*) are placed on the force applying surface 360*s* of the doctor blade 360 (i.e., where the pressing force $f_1$ is applied to the force applying surface 360*s* of the doctor blade 360). Further, in the example of FIG. 18, both of the number of the weights 1010 and the number of the arms 1020 are four so that the number of the positions where the pressing forces $f_1$ are applied by the weights 1010 and the number of the positions where the supporting forces $f_2$ are applied by the arms 1020 are equal to each other. As a result, the pressing forces $f_1$ applied by the weights 1010 and the supporting forces $f_2$ applied by the arms 1020 can establish a one-to-one correspondence. As a result, the pressing force $f_1$ applied to the blade mounting portion 410 through the force applying surface 360*s* of the doctor blade 360 is easily canceled by the supporting force $f_2$ applied to the force applying surface 411*s* of the blade mounting portion 410.

Incidentally, in the example of FIG. 18, an example in which the three cameras 1040 (1040*a* to 1040*c*) were used as a means for measuring the positions of the free end portions of the doctor blade 360 was described, but the present invention is not limited thereto. When the magnitude of the SB gap G can be measured, the measuring means may also be a sensor or a gap gauge, other than the cameras 1040. Further, the number of the cameras 1040 may also be more than three or less than three.

In the example of FIG. 18, the positions of the cameras 1040 (1040*a* to 1040*c*) are fixed, and therefore, the weights 1010 (1010*a* to 1010*d*) are disposed so as not to interfere with the cameras 1040 (1040*a* to 1040*c*). On the other hand, in a modified example in which a movable mechanism capable of retracting the cameras 1040 (1040*a* to 1040*c*) when the SB gap G is not measured is included, a region in which the weights are disposed is not limited to a particular blade of the maximum image region of the doctor blade 360.

Therefore, it is desirable that the pressing force $f_1$ is applied to the force applying surface 360*s* of the doctor blade 360 over a substantially entire region of the maximum image region of the doctor blade 360 by disposing the weights 1010 over the substantially entire region of the maximum image region of the doctor blade 360. This is because of a region of the doctor blade 360 corresponding to the maximum image region of the photosensitive drum 1, as regards a region in which the doctor blade 360 is flexed for correcting the straightness of the coating amount regulating surface 360*r*, the doctor blade 360 is fixed to the blade mounting portion 410. As a result, it is possible to suppress that of the region of the doctor blade 360 corresponding to the maximum image region, the region in which the doctor blade 360 is flexed for correcting the straightness of the coating amount regulating surface 360*r* is returned from the flexed state toward an original state before the doctor blade 360 is flexed. In view of this, in the case where the adhesive A is applied onto the blade mounting portion 410 over the substantially entire region of the maximum image region of the blade mounting portion 410, it is required that the doctor blade 360 is adhesively bonded to the blade mounting portion 410 over the substantially entire region of the maximum image region of the blade mounting portion 410. Therefore, in a period until the adhesive A is cured, there is a need to bring the doctor blade 360 into intimate contact with the blade mounting portion 410 over the substantially entire region of the maximum image region of the blade mounting portion 410, and therefore, the load is applied to the doctor blade 360 by placing the weights 1010 on the force applying surface 360*s* of the doctor blade 360 over the substantially entire region of the doctor blade 360. Incidentally, the application of the pressing force $f_1$ to the force applying surface 360*s* of the doctor blade 360 over the substantially entire region of the maximum image region of the doctor blade 360 means application of the pressing force $f_1$ to the force applying surface 360*s* in a region which is 90% or more of the region of the doctor blade 360 corresponding to the maximum image region of the photosensitive drum 1 with respect to the longitudinal direction of the doctor blade 360.

In such a case, the pressing force $f_1$ is applied to the blade mounting portion 410 over the substantially entire region of the maximum image region of the blade mounting portion 410, and therefore, it is desirable that the supporting force $f_2$ is also applied to the force applying surface 411*s* of the blade mounting portion 410 over the substantially entire region of the maximum image region of the force applying surface 411*s*. That is, the arms 1020 for applying the supporting force $f_2$ to the force applying surface 411*s* of the blade mounting portion 410 may desirably be disposed over the substantially entire region of the blade mounting portion 410. Incidentally, application of the supporting force $f_2$ to the force applying surface 411*s* over the substantially entire region of the blade mounting portion 410 means application of the supporting force $f_2$ in a region which is 90% or more of the region of the blade mounting portion 410 corresponding to the maximum image region of the photosensitive drum 1 with respect to the longitudinal direction of the blade mounting portion 410.

Then, a positional relationship between the force applying surface 360*s* of the doctor blade 360 and the force applying surface 411*s* of the blade mounting portion 410 will be described using a sectional view of FIG. 19. FIG. 19 is the sectional view of the developing device 300 in the cross section perpendicular to the rotational axis of the developing sleeve 70, and is the enlarged view of the developing device 300 in the neighborhood of a blade mounting portion 410 (particularly a blade mounting surface 410*s*) of a developing device frame 310.

An angle formed by the force applying surface 360*s* of the doctor blade 360 with respect to the blade mounting surface 410*s* is $\alpha$ ($0° \leq \alpha \leq 90°$). Further, a magnitude of the pressing force $f_1$ applied to the force applying surface 360*s* of the doctor blade 360 is $F_1$ (N), and a magnitude of a maximum static frictional force of the doctor blade 360 mounted on the blade mounting portion 410 relative to the blade mounting surface 410*s* is $M_1$ (N). At this time, a magnitude of a component of the pressing force $f_1$, with respect to a direction parallel to the blade mounting surface 410*s*, applied to the force applying surface 360*s* of the doctor blade 360 is $f_1 \sin \alpha$ (N). Therefore, in order to prevent the doctor blade 360 mounted on the blade mounting portion 410 from sliding on the blade mounting surface 410*s*, there is a need to satisfy: $f_1 \sin \alpha \leq M_1$.

In this embodiment, in the case of $10° < \alpha < 90°$, $f_1 \sin \alpha \leq M_1$ is not satisfied, and therefore, a value of the angle $\alpha$ may only be required to be set so as to satisfy: $0° \leq \alpha \leq 10°$. It is preferable that the value of the angle $\alpha$ is zero (i.e., the force applying surface 360*s* of the doctor blade 360 and the blade mounting surface 410*s* of the blade mounting portion 410 are in a parallel relationship therebetween). This is because when the value of the angle $\alpha$ is zero, the component ($f_1 \sin \alpha$), with respect to the direction parallel to the blade mounting surface 410*s*, of the pressing force $f_1$ applied to the force applying surface 360*s* of the doctor blade 360 is also zero. Therefore, when the force applying surface 360*s* of the doctor blade 360 and the blade mounting surface 410*s* of the blade mounting portion 410 are parallel to each other, the doctor blade 360 mounted on the blade mounting portion 410 does not slide on the blade mounting surface 410*s*.

Further, an angle formed by the force applying surface 411*s* of the blade mounting portion 410 with respect to a surface of the doctor blade 360 where the doctor blade 360 is mounted on the blade mounting portion 410 (hereinafter, this surface is referred to as a mounting surface 361*s*) is $\beta$ ($0° \leq \beta \leq 90°$). Further, a magnitude of the supporting force $f_2$ applied to the force applying surface 411*s* of the blade mounting portion 410 is $F_2$ (N), and a magnitude of a maximum static frictional force of the blade mounting portion 410, on which the doctor blade 360 is mounted, relative to the mounting surface 361*s* is $M_2$ (N). At this time, a magnitude of a component of the supporting force $f_2$, with respect to a direction parallel to the mounting surface 361*s*, applied to the force applying surface 411*s* of the blade mounting portion 410 is $f_2 \sin \alpha$ (N). Therefore, in order to prevent the developing device frame 310, on which the doctor blade 360 mounted, from sliding on the mounting surface 361*s* of the doctor blade 360, there is a need to satisfy: $f_2 \sin \beta \leq M_2$.

In this embodiment, in the case of $10° < \beta < 90°$, $f_2 \sin \beta \leq M_2$ is not satisfied, and therefore, a value of the angle β may only be required to be set so as to satisfy: $0° \leq \beta \leq 10°$. It is preferable that the value of the angle β is zero (i.e., the force applying surface 411*s* of the blade mounting portion 410 and the blade mounting surface 361*s* of the doctor blade 360 are in a parallel relationship therebetween). This is because when the value of the angle β is zero, the component ($f_2 \sin \beta$), with respect to the direction parallel to the mounting surface 361*s* of the doctor blade 360, of the supporting force $f_2$ applied to the force applying surface 411*s* of the blade mounting portion 410 is also zero. Therefore, when the force applying surface 411*s* of the blade mounting portion 410 and the mounting surface 361*s* of the doctor blade 360 are parallel to each other, the developing device frame 310 on which the doctor blade 360 is mounted does not slide on the mounting surface 361*s* of the doctor blade 360.

From the above, in a preferred example, the value of the angle α is zero and the value of the angle β is zero, and this means that the force applying surface 360*s* of the doctor blade 360 and the force applying surface 411*s* of the blade mounting portion 410 are parallel to each other. In the case where the force applying surface 360*s* of the doctor blade 360 and the force applying surface 411*s* of the blade mounting portion 410 are parallel to each other, this case is advantageous from the following viewpoint compared with the case where the force applying surface 360*s* and the force applying surface 411*s* are not parallel to each other. This is, in the case where the force applying surface 360*s* of the doctor blade 360 and the force applying surface 411*s* of the blade mounting portion 410 are parallel to each other, the pressing force $f_1$ and the supporting force $f_2$ may only be required to be applied so as to satisfy a relationship of $F_1 = F_2$. Thus, by a simple method such that the forces having the same magnitude are applied to the force applying surface 360*s* and the force applying surface 411*s*, respectively, all the pressing force $f_1$ applied to the blade mounting portion 410 can be canceled by the supporting force $f_2$ applied to the force applying surface 411*s*.

In this embodiment described above, the adhesive bonding of the regulating blade to the blade mounting portion with sufficient adhesive strength and the suppression of the degree of deformation of the developing device frame were compatibly realized by applying the load to the regulating blade in the state that the regulating blade is mounted on the blade mounting portion. In such First Embodiment, the fluctuation in magnitude of the SB gap with the deformation of the developing device frame can be suppressed by applying the load to the regulating blade when the regulating blade made of the resin material is fixed with the adhesive to the developing device frame made of the resin material.

Incidentally, so long as a positional relationship between the force applying surface 360*s* of the doctor blade 360 and the force applying surface 411*s* of the blade mounting portion 410 satisfies the positional relationship described above with reference to FIG. 19, a modified example described below with reference to FIG. 20 may also be employed. FIG. 20 is the sectional view of a developing device 300 in the cross section perpendicular to the rotational axis of the developing sleeve 70 and is an enlarged view of the developing device 300 in the neighborhood of a blade mounting portion 410 (especially, a blade mounting surface 410*s*) of a developing device frame 310. In an example of FIG. 20, in place of that the force applying surface 411*s* of the blade mounting portion 410 is provided on a side opposite from the blade mounting surface 410*s* of the blade mounting portion 410, the force applying surface 411*s* is provided on a side where a part of a rib 450 of the blade mounting portion 410 is cut away.

As a result, even in the case where there is no space such that the arms 1020 are disposed on the side opposite from the blade mounting surface 410*s* of the blade mounting portion 410, the arms 1020 can be flexibly disposed with no constraint of the space. In the example of FIG. 20, the arms 1020 are disposed below, with respect to a vertical direction, the surface where the part of the rib 450 of the blade mounting portion 410 is cut away. Further, in the example of FIG. 20, the arms 1020 may only be required to apply the supporting force $f_2$ to the surface where the part of the rib 450 of the blade mounting portion 410 is cut away.

Other Embodiments

The present invention is not limited to the above-described embodiments, and various modifications (including organic combinations of the respective embodiments) can be made on the basis of the intent of the present invention and are not excluded from the scope of the present invention.

In the above-described embodiments, as shown in FIG. 1, the image forming apparatus 60 having a constitution in which the intermediary transfer belt 61 is used as the intermediary transfer member was described as an example, but the present invention is not limited thereto. The present invention is also applicable to an image forming apparatus having a constitution in which transfer of the image is carried out by causing a recording material to directly contact the photosensitive drum 1 successively.

Further, in the above-described embodiments, the developing device 300 was described as a single unit, but a similar effect can be obtained even in the form of a process cartridge which is prepared by integrally assembling the image forming portion 600 (FIG. 1) including the developing device 300 into a unit and which is detachably mountable to the image forming apparatus 60. Further, when the image forming apparatus 60 includes the developing device 300 or the process cartridge, the present invention is applicable irrespective of a monochromatic (image forming) machine and a color (image forming) machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-233789 filed on Dec. 5, 2017, which is hereby incorporated by reference herein in its entirety.

What is claimed is:

1. A method of fixing a regulating blade made of a resin material to a mounting portion of a developing device frame made of a resin material, wherein the regulating blade is provided opposed to and in non-contact with a developer carrying member for carrying a developer for developing an electrostatic latent image on an image bearing member and wherein the regulating blade is capable of regulating an amount of the developer carried on the developer carrying member, the method comprising:

an adhesive applying step of applying an adhesive onto the mounting portion;

a first force applying step of applying a first force to the regulating blade so that the regulating blade is urged against the mounting portion on which the adhesive is applied in said adhesive applying step;

a second force applying step of applying a second force to the mounting portion so as to support the mounting portion on which the adhesive is applied in said adhesive applying step; and a fixing step of fixing, using the adhesive applied on the mounting portion in said adhesive applying step, the regulating blade to the mounting portion in a state in which the first force is applied to the regulating blade in said first force applying step and the second force is applied to the mounting portion in said second force applying step.

2. The method of fixing the regulating blade according to claim 1, wherein in said first force applying step, the first force is applied to a surface of the regulating blade on a side opposite from a surface of the regulating blade mounted on the mounting portion, and wherein in said second force applying step, the second force is applied to a surface of the mounting portion on a side opposite from a surface of the mounting portion on which the regulating blade is mounted.

3. The method of fixing the regulating blade according to claim 1, wherein said first force applying step, the first force is applied to the regulating blade over substantially an entire region of the regulating blade corresponding to a maximum image region of the image bearing member, and wherein in said second force applying step, the second force is applied to the mounting portion over substantially an entire region of the mounting portion corresponding to the maximum image region of the image bearing member.

4. The method of fixing the regulating blade according to claim 1, further comprising a third force applying step of applying, to the regulating blade, a third force for flexing the regulating blade so that a gap between the developer carrying member supported by the developing device frame and the regulating blade mounted on the mounting portion is adjusted to within a predetermined range along a longitudinal direction of the developer carrying member, wherein in said fixing step, the regulating blade is fixed to the mounting portion in a state that the regulating blade is kept flexed by the third force applied to the regulating blade in said third force applying step.

5. The method of fixing the regulating blade according to claim 4, wherein in said third force applying step, the third force is applied to the regulating blade in a direction in which a position of the regulating blade relative to the developer carrying member supported by the developing device frame is adjusted, and wherein in said fixing step, the regulating blade is fixed to the mounting portion in a state that the regulating blade is kept flexed in a direction in which the position of the regulating blade relative to the developer carrying member supported by the developing device frame is adjusted by the third force applied to the regulating blade in said third force applying step.

6. The method of fixing the regulating blade according to claim 4, wherein in said third force applying step, the third force is applied to the regulating blade in a state in which the regulating blade is mounted on the mounting portion on which the adhesive is applied in said adhesive applying step.

7. The method of fixing the regulating blade according to claim 4, wherein the gap is adjusted to within the predetermined range along the longitudinal direction of the developer bearing member by satisfying the following conditions:

$$0.9\times g_1 \leq g_{target} \leq 1.1\times g_1;$$

$$0.9\times g_2 \leq g_{target} \leq 1.1\times g_2; \text{ and}$$

$$0.9\times g_3 \leq g_{target} \leq 1.1\times g_3,$$

where $g_1$ is the gap at a first portion of a region of the regulating blade corresponding to a maximum image region of the image bearing member, $g_2$ is the gap at a second portion of the region of the regulating blade corresponding to the maximum image region of the image bearing member, $g_3$ is the gap at a third portion of the region of the regulating blade corresponding to the maximum image region of the image bearing member, and $g_{target}$ is a target value of the gap.

8. The method of fixing the regulating blade according to claim 1, wherein in said adhesive applying step, the adhesive is applied over a substantially entire region of the mounting portion corresponding to a maximum image region of the image bearing member.

9. The method of fixing the regulating blade according to claim 1, wherein the regulating blade has a rigidity capable of being flexed.

10. The method of fixing the regulating blade according to claim 1, wherein the regulating blade has a length corresponding to A3 size that is a length of the regulating blade at a region corresponding to a maximum image region of the image bearing member.

* * * * *